US006832824B1

(12) United States Patent
Baker et al.

(10) Patent No.: US 6,832,824 B1
(45) Date of Patent: Dec. 21, 2004

(54) COLOR-CALIBRATION SENSOR SYSTEM FOR INCREMENTAL PRINTING

(75) Inventors: Thomas H. Baker, Barcelona (ES); Nathan M. Moroney, Mountain View, CA (US); Josep Miguel Canal, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/183,819

(22) Filed: Oct. 30, 1998

(51) Int. Cl.[7] ..... B41J 29/38
(52) U.S. Cl. ..... 347/19; 347/37
(58) Field of Search ..... 347/19, 37, 39, 347/44, 24; 356/243.5, 418

(56) References Cited

U.S. PATENT DOCUMENTS

| | | | | | |
|---|---|---|---|---|---|
| 4,037,970 | A | * | 7/1977 | Webster et al. | 356/418 |
| 5,018,884 | A | * | 5/1991 | Hirano et al. | 347/30 |
| 5,255,009 | A | * | 10/1993 | Bauer et al. | 347/19 |
| 5,272,518 | A | * | 12/1993 | Vincent | 250/226 |
| 5,448,269 | A | * | 9/1995 | Beauchamp et al. | 347/19 |
| 5,508,826 | A | * | 4/1996 | Lloyd et al. | 358/501 |
| 5,537,516 | A | | 7/1996 | Sherman et al. | 250/226 |
| 5,568,266 | A | * | 10/1996 | Ciza et al. | 250/226 |
| 5,600,350 | A | | 2/1997 | Cobbs | 347/19 |
| 5,671,059 | A | * | 9/1997 | Vincent | 250/226 |
| 5,883,646 | A | * | 3/1999 | Beauchamp | 347/19 |
| 6,058,357 | A | * | 5/2000 | Granger | 702/104 |

OTHER PUBLICATIONS

Thermagon, Inc. New Literature Release [online], Aug. 15, 1997 [retrieved on Oct. 30, 2000]. Retrieved from the Internet:<URL: http://www.thermagon.com/news.htm>.*

* cited by examiner

*Primary Examiner*—Thinh Nguyen
*Assistant Examiner*—Julian D. Huffman
(74) *Attorney, Agent, or Firm*—Peter I. Lippman

(57) ABSTRACT

In one form of the invention, one sensor determines mutual alignment of pens; a second sensor measures color of dots formed on a print medium by the pens. Another form has two carriages—one moving pens to mark on a medium and the second used to refine quality of images produced. In a third form, a sensor measures color of test patterns by one or more pens; a hood—generally around the sensor laterally relative to a sensing direction—excludes ambient light from the sensor during measuring; a mechanism advances the hood along the sensing direction toward the patterns. In a fourth form, a pen ejects multiple liquid-ink drops onto a medium, and a sensor infrequently measures color of resulting dots—only when the pen is not forming images. In addition to these four forms of the invention, three others are detailed in the text.

40 Claims, 8 Drawing Sheets

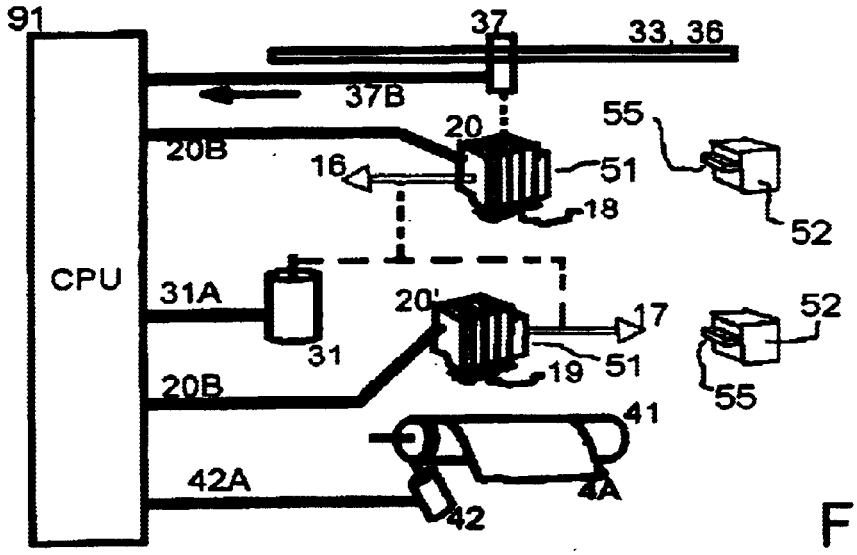
Fig. 5
Fig. 6
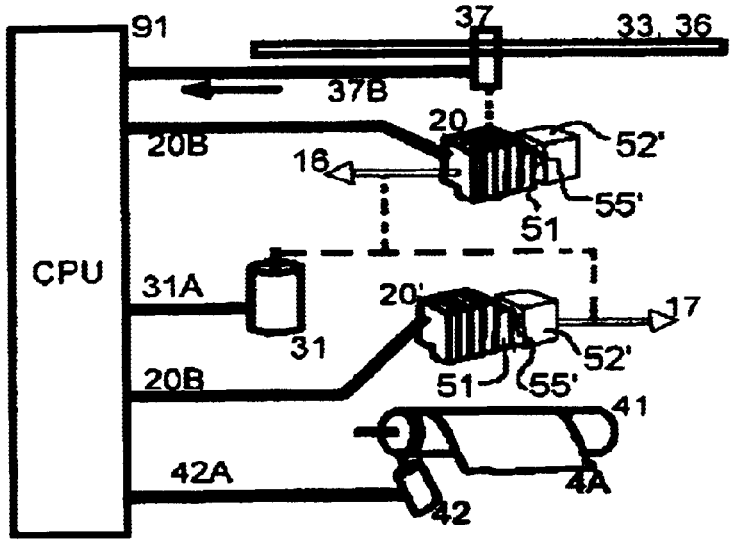

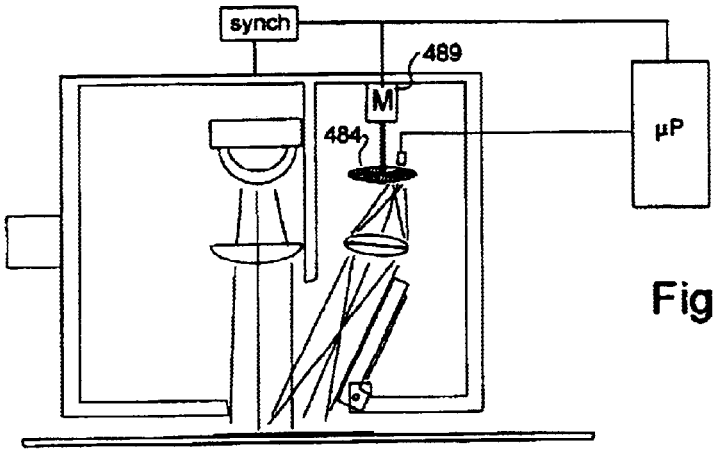
Fig. 13
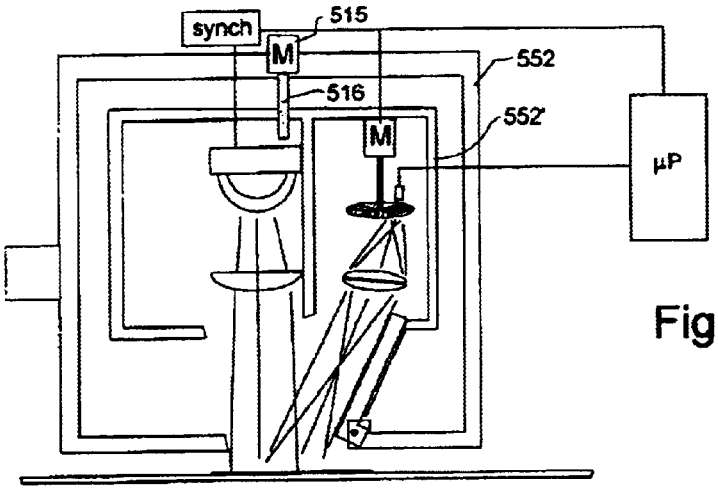
Fig. 14
Fig. 15
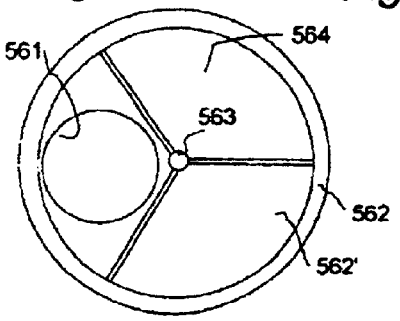
Fig. 16
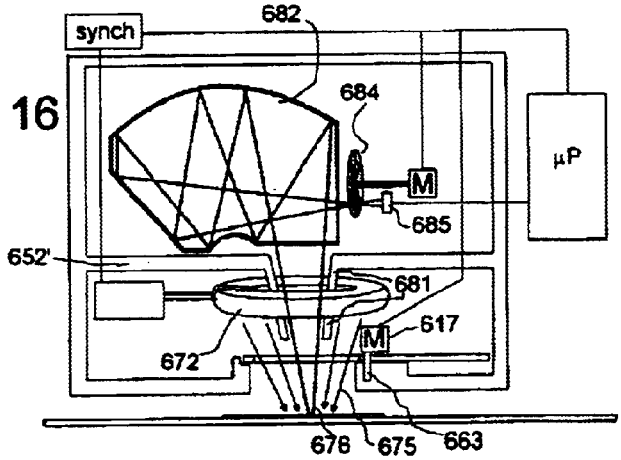

COLOR-CALIBRATION SENSOR SYSTEM FOR INCREMENTAL PRINTING

RELATED PATENT DOCUMENTS

Closely related documents are other, coowned and copending U.S. utility-patent applications filed in the United States Patent and Trademark Office and hereby incorporated by reference in their entirety into this document. One is in the names of Otto Sievert et al., Ser. No. 08/625,422 entitled "SYSTEMS AND METHOD FOR ESTABLISHING POSITIONAL ACCURACY IN TWO DIMENSIONS BASED ON A SENSOR SCAN IN ONE DIMENSION" and issued as U.S. Pat. No. 5,796,414; another in the names of Gregory D. Nelson et al., Ser. No. 08/636,439 entitled "SYSTEMS AND METHOD FOR DETERMINING PRESENCE OF INKS THAT ARE INVISIBLE TO SENSING DEVICES", and issued as U.S. Pat. No. 5,980,016; yet another in the name of Jack H. Schmidt, Ser. No. 08/665,777, "SWATH SCANNING SYSTEM USING A REFLECTING IMAGER", and issued as U.S. Pat. No. 6,088,134; yet another in the names of Robert Haselby et al., Ser. No. 08/717,921 for "UNDERPULSED SCANNER WITH VARIABLE SCAN SPEED, P. W. M. COLOR BALANCE, SCAN MODE", and issued as U.S. Pat. No. 5,991,055; a further one in the names of Chris T. Armijo et al., Ser. No. 08/811,412, "DETECTION OF PRINTHEAD NOZZLE FUNCTIONALITY BY OPTICAL SCANNING OF A TEST PATTERN", and now issued as U.S. Pat. No. 6,352,331; still another in the names of Francis Bockman et al., Ser. No. 08/960,766, "CONSTRUCTING DEVICE-STATE TABLES FOR INKJET PRINTING", and issued as U.S. Pat. No. 6,178,008; and yet another in the name of Ramon Borrell, Ser. No. 09/146,858, "ENVIRONMENTAL AND OPERATIONAL COLOR CALIBRATION, WITH INTEGRATED INK LIMITING, IN INCREMENTAL PRINTING", and issued as U.S. Pat. No. 6,585,340.

Also wholly incorporated herein by reference is U.S. Pat. No. 5,600,350 of Cobbs et al. (assigned to the Hewlett Packard Company).

FIELD OF THE INVENTION

This invention relates generally to machines and procedures for incremental printing or copying of text or graphics on printing media such as paper, transparency stock, or other glossy media; and more particularly to a machine and method that constructs—under direct computer control—text or images from individual colorant spots created on a printing medium, in a two-dimensional pixel array. For purposes of this document, by the phrases "incremental printing" and "incremental printer" it is meant to encompass all printers and copiers that perform computer-controlled construction of images by small increments.

Incremental printers thereby form images either directly on the print medium—as in the case of ink-jet, dot-matrix or wax-transfer systems—or on an electrostatically charged drum just before transfer to the medium as in the case of laser printers. Thus by "incremental printer" it is meant to exclude printing presses, which form a whole image from a previously prepared master negative or plate. The invention relates most particularly to hardware for use in calibration to optimize color effects, prevent overinking, and perform other functions directly related to image quality.

BACKGROUND OF THE INVENTION

1. Introduction

Printer users have a need for accurate color reproduction, for a very great variety of reasons. Many businesses depend on color for their image recognition and identification. Even the optimum maintenance of trademark rights in some situations can depend upon accurate presentation of the color portions of a mark.

Much more familiar motivations include the desire of hobby and home users to see natural flesh tones in printed reproductions of photographs, and to see colors in graphic designs that match their originals.

Colors machine-printed as arrays of ink dots are affected by a wide range of factors including temperature, humidity, ink viscosity, absorption by paper or other printing media, writing-mechanism wear, and many others. All these factors cause variation in inkdrop volume and thereby dot size on the media.

Efforts to analyze such factors and take them into account typically center about optical measurements of one type or another. These may be made at the factory for a complete line of printers, or made in the field for a single production unit—or skilfully devised combinations of these alternatives.

U.S. Pat. No. 5,537,516 of Sherman et al. offers (columns 2 and 3) a brief but helpful orientation as to the differences between measurements respectively made with a densitometer, a colorimeter and a scanner. Sherman also offers several proposals for using a scanner to calibrate a printer.

These proposals include various regimes of combined factory and field measurements, linked through specially constructed standard or customized target test patterns. Sherman also teaches defocusing or diffusing the targets to minimize adverse characteristics of scanners.

Although color accuracy of chromatic colors is of enormous importance commercially, for purposes of the present document (including the claims) the word "color" is used to encompass both chromatic and nonchromatic colors. Similarly the term "colorant" is used to encompass both chromatic and nonchromatic colorants.

General phrases such as "color measurement" are used to encompass both densitometry and colorimetry. In particular they encompass measurement of exclusively nonchromatic colors, as well as measurement of chromatic colors either alone or mixed with nonchromatic colors.

U.S. Pat. No. 5,272,518 of Vincent, assigned to the Hewlett Packard Company, describes a small handheld calorimeter for use in calibrating incremental printers and other image-related devices associated with computers. To exclude ambient light the device includes a hood that is meant to be manually brought down directly against a calibration test pattern.

Vincent at one point may seem to suggest too that a calorimeter such as his invention may be incorporated into the printer or other device to facilitate autocalibration; however, Vincent does not teach how to implement any such suggestion. In addition, Vincent teaches extensively the theoretical foundations of calibration for image-related devices of the type under consideration here.

It is known in handheld calorimeters and the like to use a gas-arc flashlamp, particularly for the benefits of the broad, relatively flat and somewhat controllable spectral emission of such a lamp. Neither the Vincent system, however, nor any known system of light measurement used in a printer, employs such a lamp.

2. Densitometry

For a given set of inks with known spectral values and a known printing medium, one can calculate a color table that maps a desired color in some color space into a set of values to be printed on the media. These values may be given as a percentage of the medium to cover with each of the inks.

A color table is created for each unique combination of ink and printing medium. To compensate for dot-size variation, the color table should be adjusted or calibrated for the current operating conditions.

One way to accomplish this is through a density measurement for each of the inks used, by first printing a series of swatches at various nominal (intended) densities, then measuring the actual density of the samples. What is measured is the fraction of the medium that is covered by the dots, and in most densitometer methodologies the actual color does not matter.

This process depends on the composition of the ink remaining constant, and likewise the spectral characteristics of the medium. Typically these tables are computed during development of a printer, and stored permanently in the printer—where they can be changed only by replacing the software storage component, typically a read-only memory (ROM) circuit board.

Through proper use of such measurements, it is possible to compensate for all the factors that affect dot size—thus making the color output of the printer more consistent—but the calibration is valid only for a current set of environmental conditions, inks and media. A change in temperature therefore would require a new calibration.

Later calibration is not possible with a different medium for which no color table exists. Also it is assumed that the colors do not interact—each ink is linearized independently of the others, in a one-dimensional calibration.

3. Colorimetry

To extend the calibration process to be more general, it is necessary to measure actual spectral values of ink at different levels of coverage on the desired medium. This accounts for interaction of inks and media, and makes the process independent of foreknowledge of ink and medium spectral characteristics.

In this process there is an interaction between the ink colors, because of the overlap between the spectra of the different inks. Although an ink is treated as contributing color in a single spectral band, essentially every ink actually has components in more than one part of the spectrum.

This is a multidimensional calibration. This process creates custom color tables for current ambient conditions and arbitary ink and media. In addition, such measurements in effect linearize the first type of calibration mentioned above.

4. Methods

At least two methodologies are known heretofore for calibration of incremental color printers:

(a) Off-line calibration—In this approach a user operates a spectrally discriminating optical sensing device, i. e. a calorimeter, to make measurements of a test pattern. The calorimeter readings are taken independently of the printer operation.

First the printer must be used to print the test pattern onto the desired medium. Modernly this process is controlled by an application program in a host computer or in an onboard microprocessor that is part of the printer itself. The pattern usually includes many color patches, typically between fifty and several hundred.

Then the user must operate a calorimeter—such as for example a small unit sometimes called a "color mouse". (The term "color mouse" appears to be related to, but not one of, the trademarks of the Color Savvy Company.)

Alternatively the user may use a spectrophotometer. In either case, the equipment is used to measure the patches one by one while the readings are processed by the application program. The application in turn creates a custom color table for the instant set of conditions.

The application then can send accurate color values to the printer (which should not modify them). If the temperature or another condition changes, then the calibration should be done again.

Problems with this method include the amount of time required of the user to carry out a tedious process, and the likelihood of error. For example, the user may place the sensor over a patch other than the one expected by the system.

Data obtained are ordinarily exterior to the printer and require use of an external processor, though the data may be downloaded to the printer if the system is so configured. (Another issue in some parts of the world is the physical space required to put down a print sample with swatches on a level surface for measurement.)

(b) Automatic on-line calibration—A second method is automatic and was pioneered by the Hewlett Packard Company in its DesignJet® 2500CP printer. That product uses a sensing element designed for other purposes (determining pen alignment and pen condition) to make a rough density measurement.

Examples of such sensing elements and their uses appear in U.S. Pat. No. 5,600,350 of Cobbs et al. (assigned to the Hewlett Packard Company) as well as the copending patent documents listed earlier. In general these sensing elements are very rough in comparison with true densitometers, but very slightly modified to provide some selective spectral sensitivity to the several inks involved.

As suggested by Cobbs, a representative low or lowest printing speed is e. g. roughly 13 inches per second (ips), or about 34 cm/sec. Cobbs likewise indicates that a representative intermediate speed is roughly 17 ips (42 cm/sec) and a representative high or highest speed is e. g. roughly 27 ips (68 cm/sec).

In a scanning inkjet printer such as the 2500CP, the sensor is mounted on the moving carriage that holds the inkjet pens. As is well known, the carriage moves the pens back and forth across the printing medium to eject swaths of ink droplets onto the medium, while these swaths are arrayed along the length of the medium by lengthwise advance of the medium, to form the image.

Accordingly, placement of the optical sensing element on the carriage gives the sensor access to essentially the same full area of the printing medium as the pens have. Thus the pens can be used to print test-pattern swatches on the medium, and then after the ink is thoroughly dry the medium bearing the test pattern can be fed through the machine again for measurement.

When applied to color calibration, the sensing element is used to make measurements of swatches that go from white (bare media) to opaque (complete ink coverage), in for example eight steps. Light-emitting diodes (LEDs) are used to illuminate the swatches, while a photodetector reads the amount of light reflected from the swatches. The LEDs are chosen so that the inks absorb the light well, or in other words appear dark to the photodetector.

The detector is moved across the swatches with LED illuminators operating, and the detector readings are recorded. The relative density of each swatch is calculated and used to correct what may be called the "gain" of each ink.

Two LEDs are-used—a green one for use with cyan, magenta and black inks, and a blue one for use with yellow. This method provides a measure of feedback to keep the color of a printer relatively constant, but does not provide an absolute color specification. It requires lookup tables prepared in advance for each combination of ink and printing medium.

This method, even with its simple brightness measurements combined with selective spectral excitation, still remains something less than densitometry—in this document for ease of reference it will be called "pseudodensitometry". The use of a blue LED for detecting the yellow ink is adopted merely as a means of being able to detect that color of ink with anything approaching adequate signal-to-noise ratio.

Thus pseudodensitometry does not at all closely approach colorimetry. Problems with this method include these:

1) As the detector moves, it cannot touch the medium and so is held about 1.5 mm above the medium. This standoff spacing allows ambient light to enter the detector where it generates noise and makes readings uncertain.
2) Ink-aerosol particles from the printing process drift through the atmosphere above the medium and onto optical surfaces and coat those surfaces. There are two adverse effects: (a) the coating reduces the amount of light transmitted, making the measurement less sensitive, and (b) as the particles are colored they selectively distort the light which they pass through or reflect.

A fixed cover glass is used to protect the optical elements from aerosol—and when light transmission falls below acceptable levels, the user is prompted to replace the glass. In the meantime the system suffers the progressively drifting color inaccuracy just described at (b).

Historically the required replacement frequency has been about once a year. Recent data, however, suggest that somewhat more-frequent replacement is in order. With a true calorimetric system, replacement would be required significantly more often.

3) No absolute reference is used except the bare medium.
4) No colorimetric data are possible—only density.
5) The full-ink-coverage point is not accurate. The printer can only print one dot at each addressable location, and in the worst case these dots do not completely cover the medium. Therefore the nominal-full-coverage point is not really measured with full coverage, but the software has to assume that it is.
6) Color tables are available for only a few media. Arbitrary media must be operated on a completely open-loop basis.
7) Variation in sensor-to-medium distance changes the calibration.

5. Conclusion

As shown above, problems of color consistency—and calibration such as needed to achieve it—have continued to impede achievement of uniformly excellent inkjet printing on various industrially important printing media. Neither the time-consuming and error-prone colorimetric method, on the one hand, nor the automated but fundamentally inaccurate pseudodensitometric method, on the other hand, is able to provide fast, reliable, high-quality but economical performance.

Precisely that kind of performance is essential in the highly competitive field of modern incremental printing. Thus important aspects of the technology used in the field of the invention, particularly with regard to hardware systems for use in efficient and accurate calibration of printers, remain amenable to useful refinement.

SUMMARY OF THE DISCLOSURE

The present invention introduces such refinement. Before offering a relatively rigorous introduction to the invention, this text will provide some informal comments that may be helpful in orientation. These remarks have been reserved for the present section of this document because they are in no way a part of the prior art (or parallel developments) in color calibration. It is to be understood that these preliminary comments are not a definition or description of the invention.

As suggested in the preceding "Background" section, the theory and procedures of calibration have been well-elaborated in the art, but available hardware heretofore has not been adequate. For an inkjet printer, a first step according to the present invention is to consider installing into the printer a calorimeter, rather than basically a pseudodensitometer as in method (b) above.

Vincent may suggest something of the sort; however, like the pseudodensitometer the colorimeter must be moved around to measure swatches. One question is how to accomplish that.

A natural start according to the present invention is simply to mount a calorimeter such as Vincent's directly on the scanning pen carriage, as done for the pseudodensitometer. An obstacle arises immediately as commercially available colorimeters—even the "color mouse" devices—are far too bulky and heavy to be so mounted.

The Vincent type is greatly advanced in comparison with earlier devices described in Vincent's introduction. Nevertheless it is plainly not designed or suitable for either installation or operation on a pen carriage.

A colorimeter typically requires some provision for spectral selection that is better coordinated with the sensitivities of the human eye than the simple ink-related LED colors of the pseudodensitometer. The calorimeter accordingly may have rotating filter wheels or other mechanically elaborate components that would be impractical to operate on a scanning inkjet-pen carriage.

In this regard it is necessary to appreciate some limitations of the scanning carriage. The carriage is part of a multifaceted printing system that is extremely well optimized for the highest possible image quality and the highest possible throughput.

No part of that system can be significantly perturbed without disturbing this delicate balance of electronics, mechanics, thermodynamics, fluid dynamics, chemistry, and economics. In particular the carriage must be accelerated to printing speed and decelerated to a stop for each pass of the printing elements across the medium.

The acceleration and deceleration demands naturally limit the maximum mass that the carriage can bear, to ensure a proper lifetime for the components of the carriage movement system. Assuming that the drive motor can deliver adequate torque to accelerate and decelerate the carriage to and from printing speed within the necessary times and distances, a more massive carriage or components on the carriage introduce more heat, stress and wear and thus a shorter life for the whole system.

In addition the dimensional envelope of the carriage assembly is restricted by the presence of ink containers, user access for replacement, replenishment or servicing of those containers, drive electronics, connecting drive cables, and a position-encoding strip that must be threaded entirely through the carriage. For all these reasons a color sensor even remotely the size or mass of Vincent's, for example, would be wholly impractical to mount on a conventional inkjet printer carriage.

It will be understood that design of a colorimeter small and lightweight enough to be suitable for such mounting is a major project in itself, and relatively daunting. The heart of such a new calorimeter is one principal thrust of the present document, but some innovations introduced in this document instead pursue an alternative approach without a new lightweight colorimeter.

One consideration that can be exploited to provide such an alternative solution to the calorimeter problem is that color calibration is performed very infrequently, in comparison with the conventional movements of an ink-jet pen carriage. One estimate is one color calibration for each 10,000 to 30,000 printing passes.

This consideration suggests that placing the color sensor on the carriage would add weight, bulk, stress, wear and complexity which would be rarely used—and therefore extremely cost-inefficient. Implementing a color sensor in a different location would therefore be more advantageous.

Still, the carriage is appealing because it provides access to all the necessary parts of a test pattern and already has the necessary associated components for both motive forces and positional determination. The sensor must be moved to each of the test-pattern patches (or the patches to the sensor, or some of each).

One other type of printer subsystem has a comparably very low duty cycle—namely a paper-cutter wheel that is used to slice off completed drawings from a continuous roll of printing medium. It is known to operate such a paper cutter on a separate carriage that need not be accelerated and decelerated dozens of times per image.

The separate carriage in that case is not provided with its own drive cables or position-determining components, but rather is coupled to the main carriage—for positioning by those components already associated with the main carriage. No such auxiliary carriage, however, has ever been used for positioning a module or subsystem that is directly related to color calibration, color refinement, or indeed any other aspect of image quality.

With these introductory comments in mind, this document will now continue with a more-formal presentation of certain aspects of the invention.

In its preferred embodiments, the present invention has several aspects or facets that can be used independently. With limited exceptions that will shortly become clear, the several facets are preferably employed together to optimize their benefits.

In preferred embodiments of a first of its facets or aspects, the invention is an incremental printer for forming desired images on a printing medium, by construction from individual marks in arrays. The printer includes at least one colorant-placing module for marking on the medium.

It also includes a first sensor for determining condition or relative positioning (or both) of the at least one colorant-placing module; and in addition a second sensor for making color measurements of marking arrays formed on the medium by the at least one module.

In this document (including the claims), as noted earlier the term "colorant" encompasses nonchromatic colorant; and the phrase "color measurements" encompasses both densitometry and colorimetry. The phase "relative positioning" encompasses positioning of a single colorant-placing module relative to its carriage or the printing system generally, and also encompasses positioning of plural colorant-placing modules relative to one another. As will be clear, the first sensor may take the form of separate sensors for determining condition and positioning respectively.

The foregoing may constitute a description or definition of the first facet of the invention in its broadest or most general form. Even in this general form, however, it can be seen that this aspect of the invention significantly mitigates the difficulties left unresolved in the art.

In particular, the invention provides a color-calibration sensor that is distinct and separate from the carriage-mounted sensor used for pen alignment, detection of empty ink cartridges or inkdrop size, or identification of malfunctioning nozzles. As a result the designer of a printer is enabled to decouple the color-calibration system design from the limitations of the carriage-mounted pen alignment/status sensor.

In other words, it becomes possible to solve the special problems of color calibration without insisting upon compatibility of the two disparate sensing functions. Detailed results of such less-restricted design will be seen later in this document—but those further inventive details in a certain sense flow from the innovation of this first aspect of the invention.

Although this aspect of the invention in its broad form thus represents a significant advance in the art, it is preferably practiced in conjunction with certain other features or characteristics that further enhance enjoyment of overall benefits. For example preferably the second sensor is for making calorimetric measurements.

It is also preferred that the printer additionally include a colorant carriage—for scanning the at least one colorant-placing module over the printing medium. Also preferably the first sensor is mounted to the colorant carriage but the second sensor instead is mounted independently of the first sensor.

In this case it is further preferred that the printer also include an auxiliary carriage for holding the second sensor and scanning the second sensor over such medium. This auxiliary carriage in turn preferably is selectively attachable to and detachable from the colorant carriage.

Another basic preference as to the first aspect of the invention, in certain embodiments, is that the printer include some means for excluding ambient light from the second sensor during the making of color measurements. For purposes of generality and breadth in discussion of the invention, in the present document these means will be called simply the "ambient-light excluding means".

Preferably these ambient-light excluding means include a hood generally surrounding the second sensor laterally with respect to a sensing direction, and a mechanism for advancing the hood along the sensing direction toward the medium.

Still other preferences as to the first facet of the invention, in certain embodiments, are that the printer include a mechanism for advancing the second sensor into a measurement position—and a mechanism for advancing the second sensor into contact with the medium. In addition preferably the printer includes means for presenting at least one color reference target to the second sensor. Again for generality and breadth these means will be called, in this document, the "presenting means".

In preferred embodiments of a second of its main aspects, the invention is an incremental printer for forming desired images on a printing medium, by construction from individual marks in arrays. The printer includes at least one colorant-placing module for marking on the medium.

It also includes a first carriage for scanning the colorant-placing module over the medium. In addition it includes a second carriage, discrete from the first carriage, for use in refining the quality of images produced by the printer.

The foregoing may serve as a description or definition of the second facet of the invention in its broadest or most general form. Even in this general form, however, it can be seen that this aspect of the invention too significantly mitigates the difficulties left unresolved in the art.

In particular, in this facet of the invention the source of certain previously discussed limitations of the prior art is now localized in the scanning carriage. This is a major conceptual step from the summary of the preceding "Background" section of this document—which could only point in a much more abstract way to "time-consuming and error-prone" colorimetry and "automated but fundamentally inaccurate" pseudodensitometry.

As seen in the light of this second aspect of the invention, what makes colorimetry or true densitometry time consuming and error prone is its historical inaccessibility to the already-available carriage (due to overly bulky or heavy components used in colorimetry). What makes pseudodensitometry fundamentally inaccurate is that it is limited to what can be carried on the already-available carriage.

The second facet of the invention, now under discussion, makes it possible to break out of this circular-seeming conundrum. This is accomplished by providing two separate and distinct carriages—once again to decouple the requirements of color measurement from those of the printing process itself, and from those of relatively primitive pen-status or alignment systems.

Although this facet of the invention in its broad form thus represents a significant advance in the art, it is preferably practiced in conjunction with certain other features or characteristics that further enhance enjoyment of overall benefits. For example preferably the second carriage is selectively attachable to and detachable from the first carriage.

Also it is preferable that the second carriage scan a sensor over the medium. In this case, still more preferably the sensor is a sensor for making color measurements of marks formed on the medium by the at least one colorant-placing module—and preferably the second carriage also holds at least one reference target for presentation to the sensor. (Alternative mounting of targets stationarily, to fixed components of the printer, will be taken up shortly.)

As to the last-mentioned preference, the second carriage itself actually holds not only the sensor but also a target for the sensor to view. This target may be made to function as an absolute calibration standard—which enables the system to escape from a previously discussed handicap of automatic in-printer calibration, namely the absence of an absolute standard. In this regard preferably the sensor is a calorimetric sensor, and the reference target is a calorimetric reference target.

Yet another preference is that the printer also include a hood generally surrounding the sensor laterally with respect to a sensing direction—and a mechanism for advancing the hood along the sensing direction toward the medium. It is also preferable that the printer include a mechanism for advancing a component associated with the sensor into contact with the medium.

Such a component, merely by way of example, might be the hood or a compliant facing fixed to the hood. In addition this second facet of the invention is amenable to other applications—as for instance a video camera or the like mounted to the second carriage can usefully measure image-quality-related parameters other than color.

In preferred embodiments of a third basic aspect or facet, the invention is an incremental printer for forming desired images on a printing medium, by construction from individual marks in arrays. The printer includes at least one colorant-placing module for marking on the medium, and a sensor for measuring color properties of colorant marked on such medium by the colorant-placing module.

In addition the printer includes a hood for excluding ambient light from the sensor during the color-property measuring. The hood generally surrounds the sensor laterally with respect to a sensing direction. In addition the printer has a mechanism for automatically advancing the hood along the sensing direction toward the medium.

The foregoing may constitute a description or definition of preferred embodiments of the third facet of the invention in its broadest or most general form. Even in this general form, however, it can be seen that this aspect of the invention significantly mitigates difficulties left unresolved in the art.

In particular, the mechanism described is able to minimize the admission of ambient light into the color-measuring system—and to do so more effectively than is possible by carrying an ambient-excluding hood always at the same distance needed for effective clearance during movement of the sensor into position.

Nevertheless, as before, for maximum enjoyment of the benefits of the invention preferably certain additional features or characteristics are included. For instance, it is preferable that the hood-advancing mechanism also automatically advance the color sensor into a measurement position.

Also preferably the hood includes, at a forward surface, a compliant material for facilitating an effective contact between the hood and the printing medium. Another preference is that the hood be movable with respect to the sensor; and that the mechanism advance the hood with respect to the sensor. For best exclusion of ambient light, the hood (or its compliant facing) is advanced into contact with the medium.

Another preference is that the printer include a door for protecting the sensor when not in use, and that the hood-advancing mechanism also include some means for opening the door for measurements by the sensor. Other preferences as to the door will appear shortly.

In preferred embodiments of a fourth of its aspects, the invention is an incremental printing system for forming desired images on a printing medium. The printing system forms the images by construction from very large numbers of individual liquid-ink drops ejected onto such medium in arrays. (Typical images modernly include many thousands of drops per square centimeter.)

The printing system includes at least one colorant-placing module for ejecting very large numbers of liquid-ink drops onto the medium. This ejection occurs substantially whenever the printing system is in use for forming images.

Also included in the printing system is a sensor, having at least one optical surface, for infrequently measuring color properties of ink previously received on the medium from the at least one colorant-placing module. This measuring occurs substantially only when the printing system is not in use for forming images.

The printing system further includes an automatic microprocessor for using the measured color properties in refining operation of the colorant-placing module. The printing system uses these measured properties to optimize the quality of images formed on the medium thereafter.

In addition the printing system includes a door for protecting the at least one optical surface of the sensor from being coated by atmospherically carried residual liquid ink. This protection is provided when the sensor is not in use—particularly including whenever the printing system is in use for forming images.

Yet additionally included is a mechanism for automatically opening the door before use of the sensor, and for automatically closing the door after use of the sensor. This mechanism enables the microprocessor to reliably optimize the quality of images, free from degradation of the measured color properties by coating of liquid ink on the at least one optical surface.

The foregoing may describe or define preferred embodiments of the fourth facet of the invention in its broadest or most general form. As will be understood, in this printing system the microprocessor may be the general-purpose processor in an associated computer, or can be a programmed microprocessor in a printer product. (By that is meant a printer case that includes the sensor, the colorant-placing module or modules, whatever mechanisms discharge those modules and position them with respect to the printing medium, and associated componentry).

If in the printer, the processor can take the form of a general-purpose processor holding a program, or reading program modules from an associated read-only memory (ROM); or the processor may be an application-specific integrated circuit (ASIC). Alternatively still, the processor can be in another separate enclosure, e. g. a raster image processor (RIP). Such RIP devices are available nowadays for use with computer-controlled printers, to avoid tying up either the computer or the printer.

This fourth aspect of the invention addresses and resolves the problems of the contaminated cover glass discussed earlier in the "Background" section. As will be seen this facet of the invention can also be exploited in connection with the lack of an absolute standard in some color-measurement systems.

This aspect of the invention is preferably practiced in conjunction with optimizing characteristics. For example preferably the door-opening-and-closing mechanism automatically opens the door substantially in preparation for use of the sensor; and also automatically closes the door promptly after use of the sensor. In some embodiments the door-opening mechanism moves the sensor into a measurement position as well.

If the sensor has multiple optical surfaces, preferably the door protects all of them from being coated with ink. Some embodiments may have two or more sensors—e. g., a sensor for measuring color properties of the previously received ink; and a separate sensor for determining, from patterns of the previously received ink, condition of the at least one inkdrop-placing module.

Such condition may include whether the module is out of ink. If there are plural placing modules, the separate sensor may be for use in determining, from patterns of the previously received ink, either the condition just described, or relative positioning of the inkdrop-placing modules—or both. This fourth facet of the invention, however, is also applicable to printing systems in which a single sensor is used for color measurement as well as the condition or positioning determinations just discussed.

Also preferably this aspect of the invention includes some means for measuring at least one absolute color reference, when the door is not open. (By "not open" is meant that the door is not admitting color characteristics of the previously received ink to the sensor.) For generality and breadth these means will be called the "absolute-reference measuring means".

In this case it is further preferable that the absolute-reference measuring means include at least one color reference target that is exposed to the sensor when the door is closed. When such a target is included, it is preferably carried on a surface of the door.

Another preference is that the door take the form of a shutter. In this case it is preferable that the shutter be in a plane generally parallel to the printing medium, and that the shutter slide open and shut generally within that plane.

A fifth facet or aspect of the invention is, in its preferred embodiments, an incremental printer for forming desired images on a printing medium, by construction from individual marks in arrays. The printer includes at least one colorant-placing module for marking on the medium, and a sensor for measuring color properties of colorant marked on the medium by the colorant-placing module.

Also included is a flashlamp for illuminating colorant marked on the medium at an intensity high enough to make ambient light substantially insignificant to the measuring process.

The foregoing may be a broad, general definition or description of the fifth aspect of the invention. As will be understood, this facet of the invention is particularly valuable for its virtually complete elimination of any need to shield the sensor from ambient light.

From the familiar use of flashlamps in photography it is well known that such lamps are readily made bright enough to essentially swamp out normal room illumination and in many cases even moderate daylight. (This is not to say that the sensor of this fifth facet of the invention is necessarily intended for operation outdoors in direct sunlight; the sensor can function well within a generally conventional printer cabinet, with the usual minimal shielding.)

Thus according to this aspect of the invention the sensor requires no large hood, and no mechanism for advancing the sensor into or away from contact with the print medium or the ink thereon. In fact the sensor requires no mechanism for advancing the sensor along the measurement direction at all.

Previous colorimeters using flashlamps—essentially for the benefit of their spectral distribution, as mentioned earlier—have employed hoods and in general have required manual advance of the hood along the measurement direction and into contact with the medium bearing the printed test pattern.

According to this facet of the invention in comparison, a great simplification is effected, and with relatively little handicap in terms of weight, bulk, or cost. Some electronic complexity is added.

As this facet of the invention has minimal need for shielding of the sensor against ambient light, preferred characteristics and features for this facet of the invention in fact include minimal provision of such shielding. Weight, bulk and cost benefits are thereby enhanced.

It is also preferable that, during the measuring, the sensor is in contact with neither the medium nor colorant marked on the medium. Mechanical simplification is thereby optimized—and because of the brightness and resulting virtually complete elimination of ambient shielding, the sensor is made and operated very differently from previous, handheld calorimeters fitted with flashlamps.

Another preference is that the flashlamp in fact operate in a flashing mode. In particular the lamp is best flashed for a time interval short enough to make energy consumption and heating by the flashlamp substantially insignificant.

A preferred embodiment of the invention in yet a sixth of its major facets or aspects is an incremental printer for forming desired images on a printing medium. The printer does so by construction from individual marks in arrays.

The printer includes at least one colorant-placing module for marking on such medium; and a sensor for measuring color properties of colorant marked on such medium by the colorant-placing module. In addition the printer includes a moving carriage for automatically positioning the sensor over colorant on such medium.

Further included is at least one reference target disposed for exposure to the sensor to provide a colorimetric reference measurement. This measurement is for use in conjunction with the measured color properties of colorant marked on the medium.

The foregoing may represent a description or definition of the sixth independent aspect or facet of the invention in its most general or broad form. Even in this form, however, it can be seen that this sixth facet of the invention importantly resolves troublesome difficulties of the art.

In particular, an absolute reference measurement can be obtained without going beyond the resources built into the printer. This expansion of resources enables automatic operation of the reference measurement as well as the color-patch measurements discussed earlier.

Although the sixth facet of the invention as couched in its most general form thus importantly advances the art, it is nonetheless preferred to practice this aspect of the invention in conjunction with other features or characteristics that optimize the enjoyment of its benefits. For example, in one preferred form of this sixth facet of the invention preferably the at least one reference target is carried on the moving carriage.

In another preferred form, it is preferred that the at least one reference target be stationary, and the moving carriage comprise means for automatically positioning the sensor over the at least one reference target. In this case it is further preferred that the printer also include a shutter for protecting the at least one reference-target, and some means actuated by the moving carriage for controlling the shutter.

In any event preferably the at least one target includes a white target. Also preferably the at least one target includes a black target. It is preferable too that the at least one reference target include one or more gray targets. Another preference is that the at least one reference target include a chromatically colored target.

The basis for these colorant preferences is well-established, for example in the Bockman and Borrell patent documents mentioned earlier. As those documents show, one of the most difficult colorimetric alignments for an incremental printer is producing accurate grays, and in particular gray-scale ramps; thus the nonchromatic references mentioned above are particularly useful.

Almost as demanding as this type of calibration, however, is the need for accurate presentation of fully saturated primary colors—and close behind that consideration is the accurate presentation of fully saturated secondaries. In incremental printing, primary chromatic inks are usually cyan, magenta and yellow—crosscombinations of which are used to form the colors usually regarded as primaries, namely red, green and blue (considered secondary inks, for purposes of incremental printing).

Hence red, green and blue targets for comparison are also very useful. When the system has difficulty approximating these as it should, a reason may be that the inks loaded into the system pens are faulty or at least in some way nonstandard, and this condition can be investigated automatically if the system has accurate reference targets for those colors as well.

All of the foregoing operational principles and advantages of the present invention will be more fully appreciated upon consideration of the following detailed description, with reference to the appended drawings, of which:

BRIEF DESCRIPTION OF THE DRAWINGS

FIG. 5 is a conceptual block-diagrammatic representation of a hardware system according to preferred embodiments of the invention, with the sensor of FIGS. 2 through 4 shown parked;

FIG. 6 is a like view but with the sensor coupled to the colorant carriage;

FIG. 13 is an elevation like FIGS. 10 and 12 but showing a sensor that uses a rotating filter wheel instead of a scanned interference filter or grating;

FIG. 14 is an elevation like FIG. 13 but showing a sensor having two cases, nested and with the interior case servo-driven to equalize focal conditions as between external test patch and internal reference target;

FIG. 15 is a plan of a combination shutter and reference target for use instead of the door in FIGS. 6 through 14;

FIG. 16 is an elevation like FIG. 13 but showing a sensor that uses the FIG. 15 shutter/target and a telecentric imager to equalize focal conditions between patch and target;

DETAILED DESCRIPTION OF THE PREFERRED EMBODIMENTS

Figure 1:
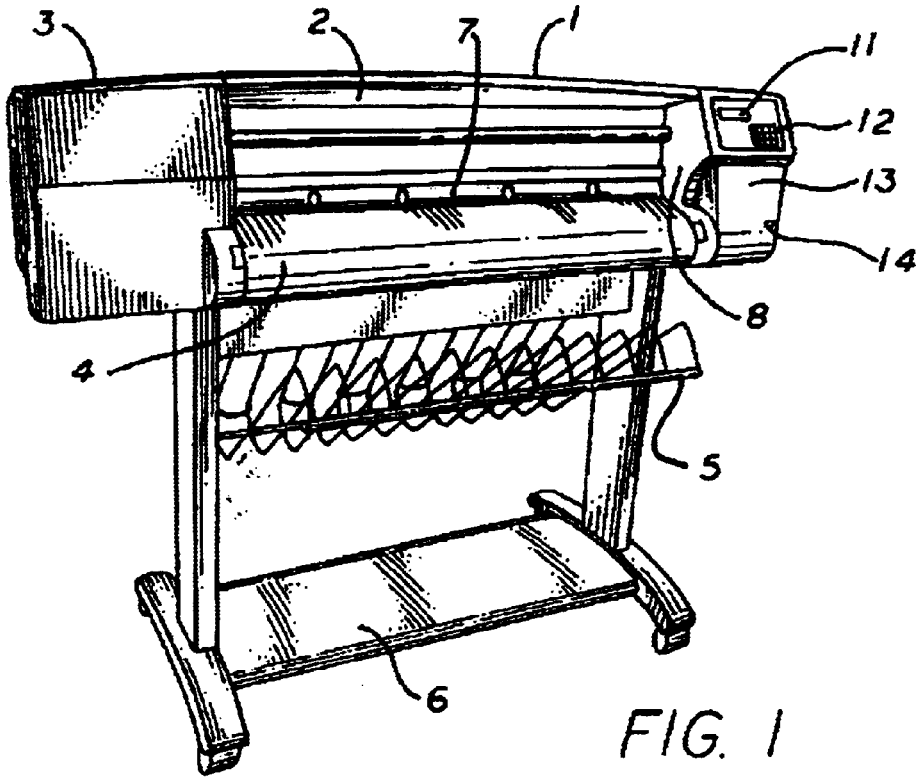
FIG. 1 is a perspective or isometric drawing, taken from front left, of a representative large-format printer-plotter that incorporates preferred embodiments of the invention.

Two preferred embodiments of the present invention are believed to be the first incremental printing system to provide densitometric or full calorimetric self-calibration, as compared with limited pseudodensitometric color calibration available heretofore. Two alternative preferred embodiments are the first commercial incremental printing system to provide pseudodensitometric or densitometric color calibration that is protected against error due to coating of optical elements by ink aerosol.

Each of these embodiments represents a major step forward over the prior art. An objective is high-quality color sensing elements that enable the overall system to have fully characterized calorimetric or spectrometric performance. A color sensor that provides color data in three or more color bands allows construction of color tables for arbitrary printing media at the time of use, rather than at the time of design.

Such tables can take into account inkdrop size and other current variables as well as the printing medium. With such a system it is not necessary to construct tables at the factory and store those tables permanently.

1. Single- and Dual-Sensor Embodiments (a) Most highly preferred embodiment—More specifically, the most favored embodiments of the present invention use a sensor excited by a high-intensity lamp that requires little or no detector shielding against ambient light. This most highly preferred sensor, when it is fitted with a suitable optical coupler and wavelength-selection unit, accordingly is considered sufficiently lightweight and compact to incorporate into an otherwise generally conventional pen-carriage assembly.

It is small enough to share the carriage with another, more elementary sensor used to determine pen condition or alignment. As will be understood, however, the preferred sensor alternatively can be adapted to take over the tasks of that other sensor as well.

Central to achieving a sufficiently lightweight and compact colorimeter to avoid a separate carriage is minimizing the use of relatively heavy solenoid actuators, stepper motors, and the like. Most commercially available calorimeter models occupy some fifteen to thirty cubic centimeters and weigh over a hundred grams.

Thus it is particularly favorable to eliminate hinged doors and translating hoods that are not only bulky and possibly heavy but also require heavy actuators. A hood can be avoided with a bright lamp, and shifting of the calorimeter to equalize focal lengths as between color swatches and target can be avoided with optics that minimize sensitivity to focus.

If an electrically activated door is to be included, both for optics protection and to facilitate provision of an onboard reference target, a circular shutter system seems preferable. Rotary sliding motion can be easily geared down for actuation by a very small, lightweight motor; yet actuation by motion of the carriage itself is preferable.

Alternatively reference targets may be stationary (that is to say, not onboard the pen or sensor carriage) and accessed by the sensor through suitably controlled movements of the moving carriage. Further elaboration of these several configurations appear in later subsections of this document.

(b) Alternative preferred embodiments—A still-highly-regarded alternative group of embodiments provides dual carriages with respective sensors that can be optimized independently for color and pen-management tasks. When used with conventional, lower-intensity lamps the color sensor here requires ambient-light exclusion.

This alternative calls for stopping the colorimeter over each test patch in turn, and also calls for an ambient-light hood or the like—to be shifted down against the print medium. The movement requires an actuator.

Nevertheless, these conditions are readily satisfied without degrading print-stage performance, since the extra weight and size of the shields is accommodated by severing requirements of the color sensor from those of the pen-condition/alignment sensor. This figurative decoupling of the requirements is achieved by literally decoupling the color-sensor carriage from the pen carriage—i. e., by placing the color sensor on an auxiliary carriage.

The auxiliary carriage ideally is just a sled that moves on the same support-and-guide surfaces as the pen carriage, and is coupled to the pen carriage when use of the color measuring system is desired. The sled is pushed to one side and decoupled when calibration is complete.

This auxiliary carriage can have very loose requirements. As it is used only very infrequently its lifetime as measured in duty cycles is very low. Its positioning accuracy need be only sufficient to position the sensor over a relatively large test patch.

As the pen carriage is only called upon to position the sled during the color-calibration reading mode, the sled need not be movable at high speed. Since it can therefore be moved rather slowly, its weight and size are not at all critical.

Electrical connections to the color sensor can be made either through a connector at the coupling point between the pen and color-sensor carriages, or through a separate conventional umbilicus extending directly between the color sensor and the printer electronics.

An auxiliary carriage is not necessarily restricted to use with the relatively heavier color sensor that has been under discussion. The sled can be used to carry the previously introduced lightweight compact sensor instead. This may be the arrangement of choice for various reasons—including for example attainment of less than ideal compactness or lightness in weight, or to incorporate other functionalities on the auxiliary carriage.

Another alternative preferred embodiment is a sensor with a door to protect optics from ink-aerosol. This embodiment may be as modest as a pseudodensitometer that is thus protected, substituted for color sensors shown below.

(c) The system—The invention is now most preferably implemented in a printer/plotter that includes a main case 1 (FIG. 1) with a window 2, and a left-hand pod 3 that encloses one end of the chassis. Within that enclosure are carriage-support and -drive mechanics and one end of the printing-medium advance mechanism, as well as a pen-refill station with supplemental ink cartridges.

The printer/plotter also includes a printing-medium roll cover 4, and a receiving bin 5 for lengths or sheets of printing medium on which images have been formed, and which have been ejected from the machine. A bottom brace and storage shelf 6 spans the legs which support the two ends of the case 1.

Just above the print-medium cover 4 is an entry slot 7 for receipt of continuous lengths of printing medium 4. Also included are a lever 8 for control of the gripping of the print medium by the machine.

A front-panel display 11 and controls 12 are mounted in the skin of the right-hand pod 13. That pod encloses the right end of the carriage mechanics and of the medium advance mechanism, and also a printhead cleaning station. Near the bottom of the right-hand pod for readiest access is a standby switch 14.

Within the case 1 and pods 3, 13 a cylindrical platen 41 (FIG. 2)—driven by a motor 42, worm 43 and worm gear 44 under control of signals from a digital electronic processor—rotates to drive sheets or lengths of printing medium 4A in a medium-advance direction. Print medium 4A is thereby drawn out of the print-medium roll cover 4.

Meanwhile a pen-holding carriage assembly 20 carries pens back and forth across the printing medium, along a scanning track—perpendicular to the medium-advance direction—while the pens eject ink. The medium 4A thus receives inkdrops for formation of a desired image, and is ejected into the print-medium bin 5. As indicated in the drawing, the image may be a test pattern of numerous color patches or swatches 56, for reading by a color sensor to generate calibration data.

A small automatic optoelectronic sensor 51 rides with the pens on the carriage and is directed downward to obtain data about pen condition (nozzle firing volume and direction, and interpen alignment). In a printer with a simple pseudodensitometric or densitometric system, this same sensor 51 may perform the necessary optical measurements for the pseudodensitometry or densitometry too.

For present purposes, furthermore, the same sensor case 51 also symbolizes a calorimetric sensor according to the most highly preferred embodiments of the invention. In such embodiments the calorimetric sensor can also be used to perform the pen-function observations. Although those embodiments, as mentioned above, are particularly compact and lightweight, they do require a somewhat larger sensor enclosure 51 than suggested in FIG. 2.

The other preferred embodiment of the present invention uses instead an auxiliary calorimeter carriage 52. This carriage houses a calorimetric sensor that is distinct from the pen-function sensor 51 but can be secured next to it by a coupling 55—or decoupled for parking, as illustrated, at the edge of the platen 41.

A very finely graduated encoder strip 36 is extended taut along the scanning path of the carriage assembly 20 and read by another, very small automatic optoelectronic sensor 37 to provide position and speed information 37B for the microprocessor. One advantageous location for the encoder strip 36 is immediately behind the pens.

Figure 3:
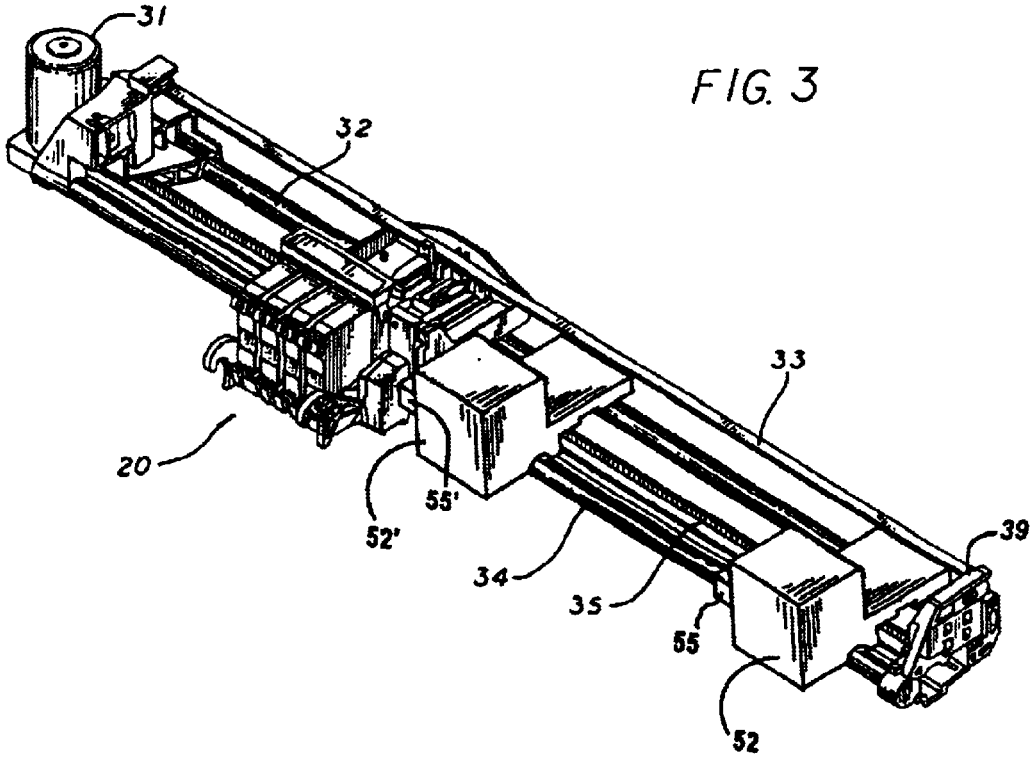
FIG. 3 is a like view, but less highly enlarged, showing the FIG. 2 sensor in two different conditions (parked, and coupled to the colorant carriage for color measurements, respectively) with almost all of the FIG. 2 carriage system.

A currently preferred position for the encoder strip 33 (FIG. 3), however, is near the rear of the pen-carriage tray—remote from the space into which a user's hands are inserted for servicing of the pen refill cartridges. For either position, the sensor 37 is disposed with its optical beam passing through orifices or transparent portions of a scale formed in the strip.

The pen-carriage assembly 20 is driven in reciprocation by a motor 31—along dual support and guide rails 32, 34—through the intermediary of a drive belt 35. The motor 31 is under the control of signals from the digital processor.

Likewise the auxiliary, calorimeter carriage and enclosure 52—present only in the alternative embodiment as explained above—rests on both rails 32, 34, whether parked next to the right end bracket 39 of the scan assembly or, if in use, coupled to the pen carriage 20 as shown at 52'. (In FIG. 3 the callout for the calorimeter carriage/housing shown adjacent to the pen carriage 20 is marked with a "prime" symbol thus, 52', to emphasize that there is actually only one calorimeter carriage, not two as might otherwise be supposed from the drawing.)

Those skilled in the art will now recognize that a parking position next to the left end of the carriage assembly is equally appropriate in the abstract. Ordinarily practical considerations for any given product will dictate which end is preferable.

Figure 4:
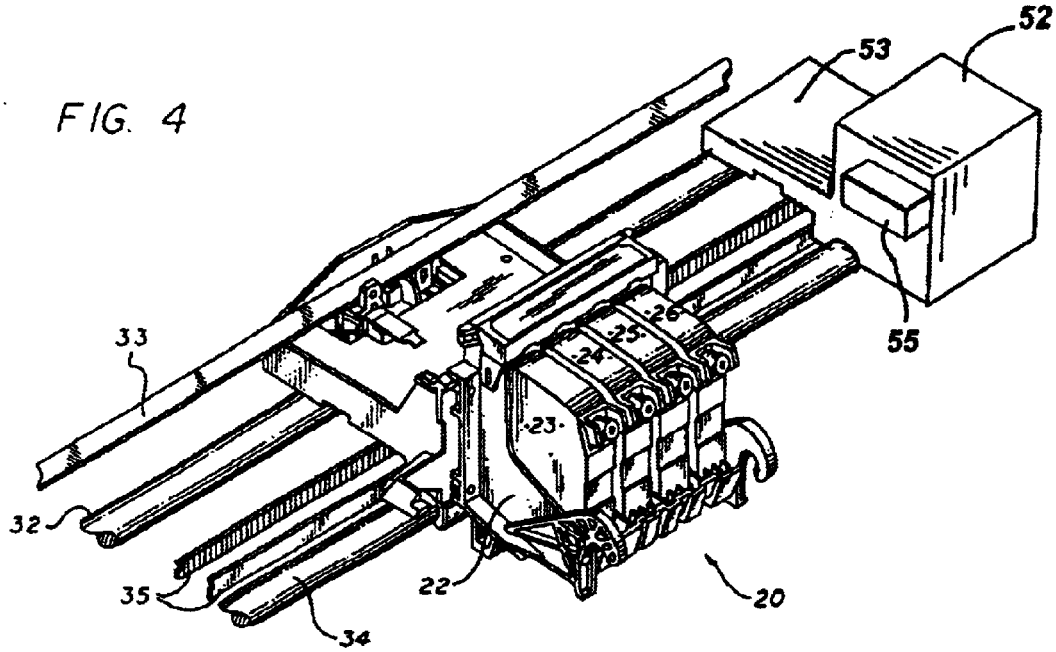
FIG. 4 is a like view but more highly enlarged and taken from front above left, and showing the same sensor decoupled from the colorant carriage.
Figure 7:
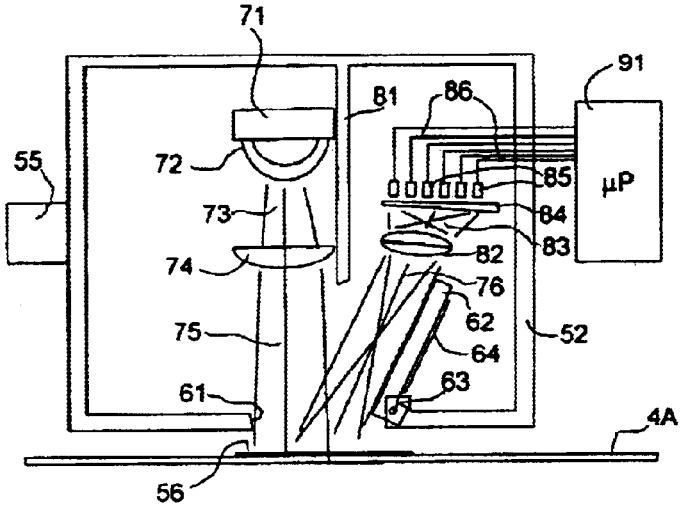
FIG. 7 is a conceptual elevation, partly in cross-section and very schematic, of a sensor according to preferred embodiments of the invention that employs a stationary graded interference filter followed by an array of detectors—shown in context with a representative printing medium and test patch, and a representative microprocessor—and shown with a sensor door open to expose the working parts of the sensor to the test patch.

Naturally the pen-carriage assembly includes bays 22 (FIG. 4) for pens—preferably four pens 23–26 holding ink of four different colors respectively. Typically the inks are yellow in the leftmost pen 23, then cyan 24, magenta 25 and black 26.

Also included in the pen-carriage assembly 20 is a rear tray carrying various electronics. The calorimeter carriage too has a rear tray or extension 53 (FIG. 2), with a step 54 to clear the drive cables 35.

In a block diagrammatic showing, the pen-carriage assembly is represented separately at 20 (FIG. 5) when traveling to the left 16 while discharging ink 18, and at 20' when traveling to the right 17 while discharging ink 19. It will be understood that both 20 and 20' represent the same pen carriage.

The previously mentioned digital processor 91 provides control signals 20B to fire the pens with correct timing, coordinated with platen drive control signals 42A to the platen motor 42, and carriage drive control signals 31A to the carriage drive motor 31. The processor 91 develops these carriage drive signals 31A based partly upon information about the carriage speed and position derived from the encoder signals 37B provided by the encoder 37.

(In the block diagram all illustrated signals are flowing from left to right except the information 37B fed back from the sensor—as indicated by the associated leftward arrow.) The codestrip 33 thus enables formation of color inkdrops at ultrahigh precision during scanning of the carriage assembly 20 in each direction—i. e., either left to right (forward 20') or right to left (back 20).

As the block diagram suggests, the auxiliary sensor or calorimeter carriage 52 remains decoupled from the pen carriage 20 and parked at right regardless of pen-carriage direction, in the writing mode of FIG. 5. This includes writing test pattern color patches 56 such as noted earlier in FIG. 2.

In colorimetric-data reading mode, however—that is, when reading those same patches 56, the pens are turned off and the pen carriage moves next to the auxiliary sensor carriage 52' (FIG. 6) and the two are then coupled together. The pen carriage and its drive and position/speed-monitoring subsystems can then be brought to bear in positioning the calorimeter carriage, and the two carriages move together.

Figure 2:
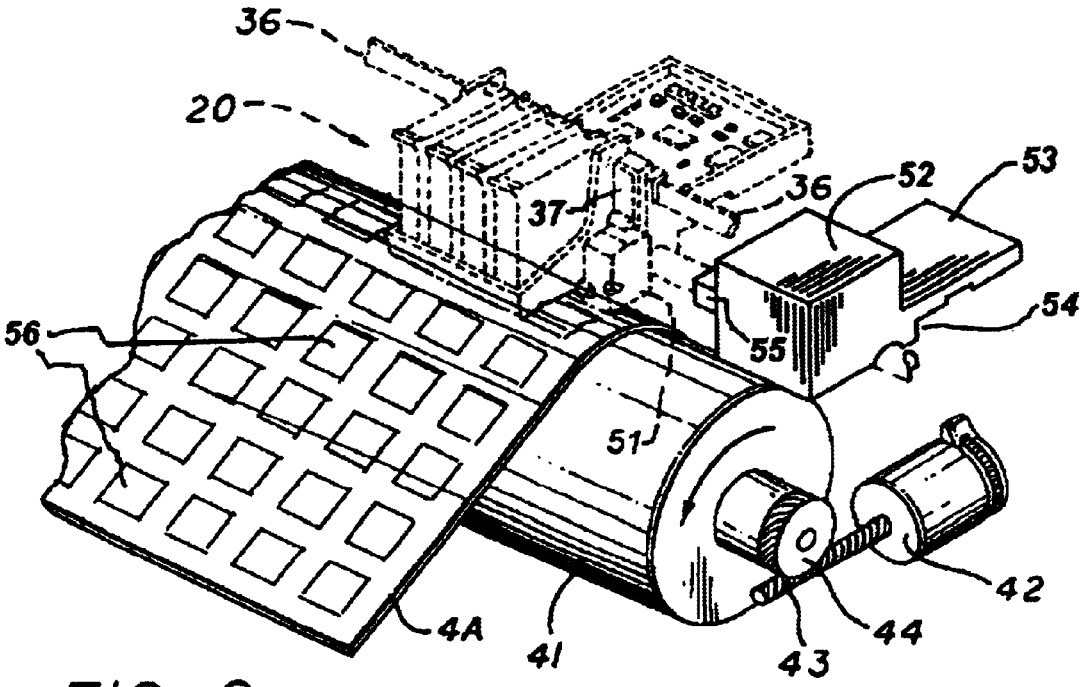
FIG. 2 is a like view, but enlarged and taken from upper front right, of a sensor according to one preferred embodiment of the invention—with the sensor seen in a parked condition, and also showing portions of the carriage and platen system in the FIG. 1 printer—and also illustrating a representative test pattern being printed for later reading by a sensor according to the invention.

While the pens remain turned off, as indicated in this second block diagram the pen carriage moves 16 the auxiliary carriage, relatively slowly, from its parked position to positions above all the patches 56 in turn. This requires coordination with position of the platen 41 and printing medium 4A, to reach the several rows of patches (FIG. 2).

Depending on the order in which the patches are read, the carriages may be called upon to reciprocate during the reading mode. When the reading is complete for all rows, the pen carriage moves 17 the calorimeter carriage back to its parking position at the right.

2. Sensor Geometry

Alternative internal structures of the auxiliary color-sensor assembly 52 appear in FIGS. 7 through 16. FIGS. 15 and 16 show the internal structure that is best adapted to serve in a single-carriage system as the sensor 51.

As seen in FIGS. 7 through 14, the color-sensor assembly 52 has a coupling 55 for engagement with the pen carriage. In the drawings this coupling is shown generically as it can take any number of different forms—for example, most preferably a latch that is operated by relative movement of the carriages. Other choices include an electromagnet that engages a ferromagnetic surface on the pen carriage, or a solenoid-operated latch, or a self-making passive latch that is solenoid broken.

A power supply 71 (FIG. 7) is onboard the auxiliary carriage to power a flashlamp 72. Relatively high voltage is required to start such a gas-discharge lamp, although as is well known the voltage drops to quite low values once the arc is struck.

Gas constituency and pressure, electrode geometry, and to an extent even characteristics of the envelope establish the brightness, spectral properties, temperature, life and specific electrical characteristic of a flashlamp. The firing waveform in turn participates in controlling all those same properties.

If a different type of light source is used, then generally a high-voltage source is not required. In that case the power supply 71 may be consolidated with the rest of the printer power supply.

Light 73 from the lamp is advantageously collected by a collimator 74 for direction as a beam 76 through the open port or doorway 61 to a test swatch 56 on the printing medium 4A. Good diffuse-reflectance measurement geometries and protocols should be observed, in collecting the reflected beam 76 through a field lens 82.

In particular, each swatch 56 scatters much of the incident beam 75 into a wide solid angle, and reflects the balance specularly at an exit angle equal to the angle of incidence. The proportions depend upon the reflectance properties of the ink and media.

The lens 82 should collect a representative sampling of the scattered light, rather than a specularly reflected sample of the source beam. Accordingly for good diffuse-reflectance measurements ideally one or the other of the two beams (incident and collected) is perpendicular to the sample, while the other beam ideally is at forty-five degrees to both the perpendicular and the sample.

The illustrated geometry is one of those two options, and those skilled in the art will recognize that the other option can be substituted straightforwardly. Both forms render the sensor advantageously unresponsive to specular reflection, thus indicating more about the character of the test samples than of the source lamp.

The source stage 71–75 is partially isolated from the detection stage 76, 82–86 by a central baffle 81, to reduce stray light in the detection stage. At this point the brightness of the flashlamp is no aid, since the brightness of any stray light is proportional to the lamp brightness.

The field lens 82 may be selected to focus the swatch 56 onto a detector array 85— through a wavelength-selecting device such as a graded (tapered) interference filter 84. Alternatively it may be desired to defocus the swatch relative to the detector array, in an effort to minimize systematic error in apparent spectral response that may arise from inadvertently correlating illumination patterns at the swatch with specific detectors in the array.

Generally philosophies of such optical relationships between the detector array 85 and other elements of the system are a matter of optics theory and outside the scope of this document, but in any event are straightforwardly managed by optics designers or engineers. One feature of the collection stage that is within the scope of the present discussion is the door 62, which if present is necessarily hinged 63 up out of the way of the beam 76.

Light of various wavelengths is selected by the thickness of the graded interference filter 84 that is respectively adjacent each detector 85 in the array. These wavelengths accordingly reach the corresponding detectors 85, producing in the detectors wavelength-varying electrical signals for passage via a bus 86 to the microprocessor 91.

Depending on the particular color swatch, the signals represent particular proportions of the different optical wavelengths, which the processor 91 is able to interpret in terms of human perceptual responses. In this way the system can construct color tables for the particular combination of inks in use and printing medium 4A in use.

In that process, however, as noted earlier it is extremely desirable to make adjustment for known absolute color values. One such value is an ideal white, which can be approximated with a magnesium oxide or equivalent reference target 64.

By hinging 65 the door 62 down—into position (FIG. 8) for protecting all the optical surfaces 72, 74, 82, 84, 85—the system also exposes the same detector array 85, through the same field lens 82, to the white reference target 64 on the back of the door 62. The reference target is now illuminated by the same light beam 75 that previously illuminated the test swatch.

Now, however, not only the focal and illumination distances but also the angles subtended by the beam on the reference target are different from the distances and angles which obtained with the door open. Furthermore the distances and therefore angles to and from the color swatch outside the port 61 are not perfectly controlled.

On the other hand, fortunately the geometry of the system with the door closed is very well defined. Therefore with care it is possible to make an arithmetic adjustment to take these differences into account with reasonable accuracy, in deriving an excellent approximation to an absolute white reference reading.

As to the problem of ink aerosol coating the sensor optics, no ink is ejected during the reading of color swatches. It is true that some ink aerosol may remain in the atmosphere immediately after the test patterns have been printed, and some of this atmosphere is admitted to the interior of the sensor chambers during the brief time when the door is then opened.

This aerosol may coat the sensor optics. Quantitatively, however, this coating is negligibly tiny in comparison with what is deposited on the unshielded prior-art cover glass. The procedure may be rendered even more remotely negligible by interposition of a brief delay between printing and reading of the test patterns.

Another desirable absolute reference reading would be a reading taken with a dead-black target. The door 62 can provide another kind of approximation to this second type of absolute reference—namely a dark-current reading.

With the lamp turned off so that it emits no light 73" (FIG. 9), and with the door blocking substantially all ambient illumination from reaching the detector array, illumination 83" at the detectors is essentially nil.

Again, a dark-current reading is not the same thing as a black-target reading with the same illumination as used on the reference white target and on the test swatches. Nevertheless, with careful preparation it is possible to establish necessary relationships between the two kinds of readings, and thereby to develop an excellent approximation to an absolute black reference reading.

Figure 8:
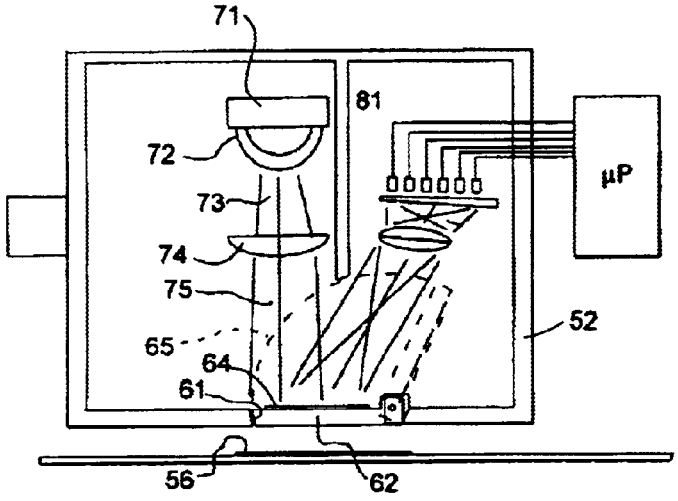
FIG. 8 is an elevation like FIG. 7 but with the door closed to instead expose the working parts of the sensor to a standard white reference target.
Figure 9:
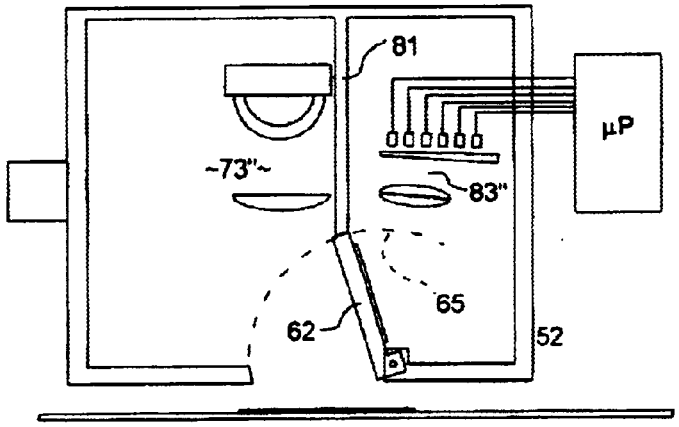
FIG. 9 is an elevation like FIGS. 7 and 8 but with the door moved to a third position in which the detector stage of the sensor is substantially isolated from all illumination.

It will be noted that the FIG. 8 position of the door 62 is very nearly as good for this purpose as the FIG. 9 position, so that in practice the lower, FIG. 8 configuration too should deliver a good black reference—but of course again with the lamp turned off. If the door is better sealed in its FIG. 8 position, then the lower position may actually be better.

More reliability may result from using a single detector 185 (FIG. 10), and scanning the wavelengths onto that single detector. (In FIGS. 10 through 13 the callout numbers correspond to those in FIG. 7, except for the use of prefix numbers in the hundreds place to call attention to the varied features.)

Synchronization signals 192 are required to coordinate the light pulses of the flashlamp with the wavelength drive 184–189 and with the interpretive steps in the processor 191- and these three sets of signals are delivered 193–195 as shown. In this case the bearing 187, screw drive 188, guideways (not shown) and motor 189 may weigh more than the several detectors 85 in FIGS. 7 through 9, but with the auxiliary-carriage configuration the extra weight is insignificant.

Better optical efficiency and therefore overall signal-to-noise ratio may be available with an inexpensive cast diffraction grating 284 (FIG. 11) illuminating an array of detectors 285. In this system an auxiliary baffle 281' in conjunction with the door helps avoid crosstalk from unwanted orders of the grating, as well as further screening stray light from the lamp stage out of the detection stage 283'-285.

Figure 10:
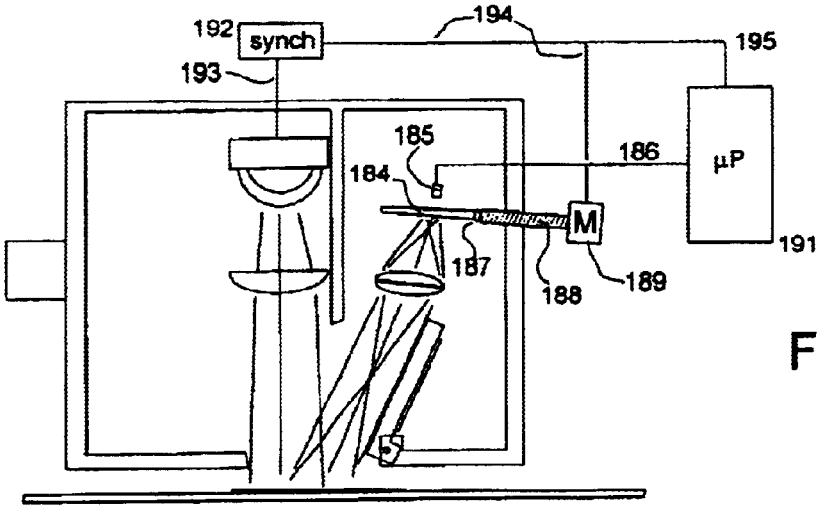
FIG. 10 is an elevation like FIG. 7 but showing the interference filter scanned and followed by a single detector.
Figure 11:
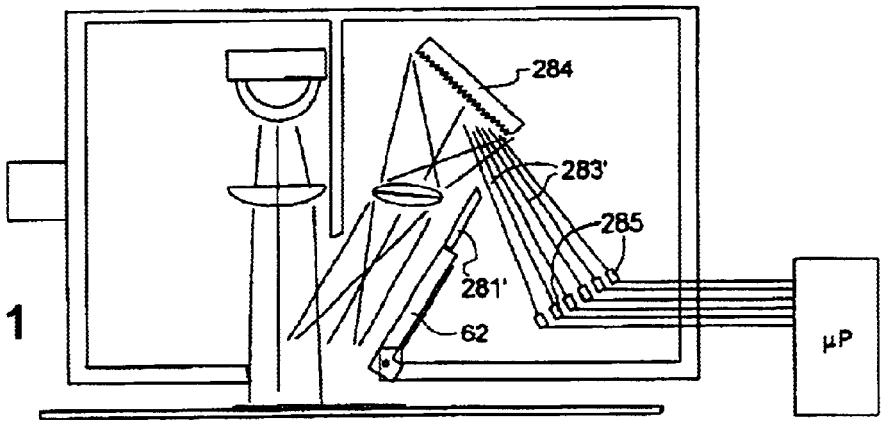
FIG. 11 is an elevation like FIG. 7 but showing a sensor that uses a stationary diffraction grating instead of a stationary interference filter.
Figure 12:
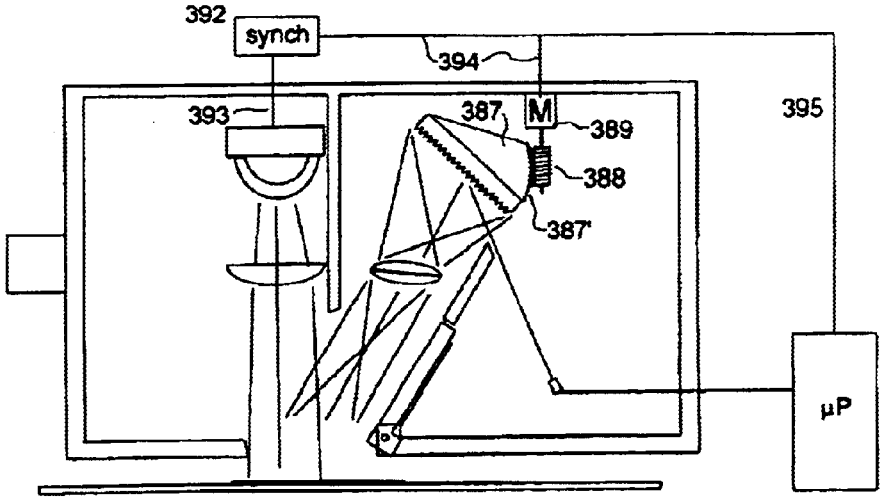
FIG. 12 is an elevation like FIG. 10 but showing a sensor that uses a scanned diffraction grating instead of a scanned interference filter.

Combining this consideration with the reliability of a scanning system as in FIG. 10, leads to a scanning grating color sensor—in which the grating is mounted to a table 387 (FIG. 12). The table rotates about an axis (not marked) that is parallel to the grating lines, passing through the face of the grate near its center.

A worm gear 387', formed in or fixed to the edge of the rotary table, is driven by a motor 389 through a worm 388. As in the scanning-filter embodiment, synch signals 392 are provided at 393 to the lamp supply, at 394 to the grating drive motor 389, and at 395 to the processor. The processor provides an electronic grating cam.

Yet another acceptable substitution is a rotating filter wheel 484 (FIG. 13) and drive motor 489. These take the place of the scanning filter or grating.

In the systems of FIGS. 7 through 13, as mentioned earlier, the different elevation of the reference white target 64 (FIG. 8) relative to the target patches 56 may give rise to some irregularities in calibration. One approach to removing this drawback is to lower the color-sensing stage relative to the platen when measuring the color patches, and raise that stage for measurements of the reference target.

Such movement can be effected by, for example, subdividing the enclosure of the color sensor into an outer shell 552 and an inner housing 552', and providing a motor 515 and screw drive 516 for controlling the vertical position of the inner housing 552' relative to the outer housing 552.

A different way of approaching the focal problem is illustrated in FIGS. 15 and 16, together with a rotating-shutter type of door. These drawings include no coupling for engagement with the pen carriage, as this system is light and compact enough to ride directly on that carriage as previously mentioned. Nevertheless if preferred the system of FIGS. 15 and 16 can be provided with a coupling and implemented as an auxiliary sensor/carriage like those of FIGS. 7 through 14.

Here the shutter 562 has three sectors—one reference white 564, one reference black 562' and the third an aperture 561. For reasons discussed elsewhere in this document, although FIG. 15 illustrates just two targets the shutter may be provided instead with as many as ten discrete reference targets, or even more.

The shutter is oriented horizontally and is operated about a vertical pin 663, fixed in the floor of the color-sensor housing 652, by a motor 611. The shutter need not turn at all quickly and so may be geared down and driven by an ordinary d. c. motor 617.

The shutter may be stopped at positions determined by economical encoders (not shown) on the rim—or preferably found by interpreting the return light signals at the main detector 685, and in particular interpolating between the signals from the centers of the dead-black and pure-white targets.

The flashlamp 672 in this case is made roughly circular, and encircles a frustoconical baffle 681 that depends from a horizontal central bulkhead 652'. Due to the difference in illumination distances, the illumination 675 at the color swatch is not as bright as that at the reference targets.

Collection distances, however, are rendered relatively unimportant through use of a telecentric imager 682 described in the above-mentioned patent document of Schmidt. Though originally conceived for use in a swath scanner, the imager 682 with routine modification is adaptable for the purpose shown.

As shown here and by Schmidt the imager is a unitary cast solid element with the four reflecting surface areas aluminized or silvered. The collected light 676 enters the cast imager at lower right, and after four internal reflections exits rightward.

From the imager, the beam passes to the detector 685, through a spinning filter wheel 684 or other wavelength-selection element such as shown in FIGS. 7 through 12. The Schmidt document also shows variant forms in which the reflectors are conventionally formed and mounted discrete mirrors.

Arithmetic compensation for the illumination inconsistency mentioned above is desirable. It can be worked out empirically, to provide an approximation for the absolute reference points which is somewhat better than that for the embodiments of FIGS. 8 through 14.

This is particularly true because collection of the reflected beam is considerably better controlled in the FIG. 16 case. As the drawing suggests, careful design of the baffle 681 can be made to partially screen the targets from the lamp, and thereby partly equalize the illumination on the targets with that on the swatches.

3. Sensor and Hood Mounting for Ambient-Light Exclusion

Figure 17:
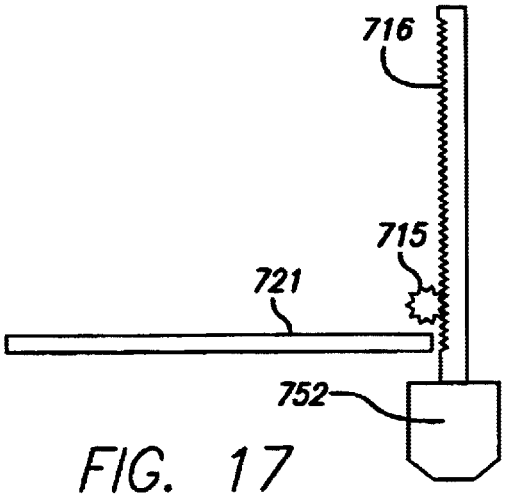
FIG. 17 is an extremely schematic elevation of another preferred embodiment in which the sensor is bodily lowered toward the printing medium.
Figure 18:
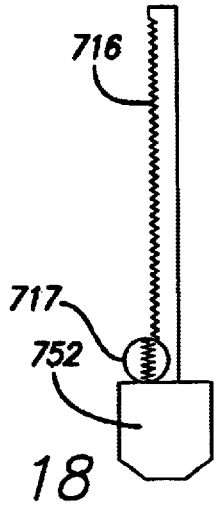
FIG. 18 is a like elevation of a variant of the FIG. 17 sensor mounting arrangement, particularly showing the sensor suspended for compliant engagement with the printing medium.

Absent an adequately bright flashlamp, the alternative solution to the ambient-light problem is mechanical. The calorimeter carriage board 721 (FIG. 17) is stopped over each test patch, and then an actuator 715, 716 pushes the color-sensor assembly 752 down against the printing medium.

The vertical motion can be achieved with an actuator formed as, for instance, a rack 716 and pinion 715. The mechanism should be biased with a spring 717 or the like to allow for height variations.

Figure 19A:
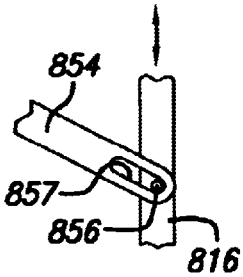
FIG. 19A is a like elevation, but greatly enlarged, showing the region 19A—19A of FIGS. 19–21.
Figure 19:
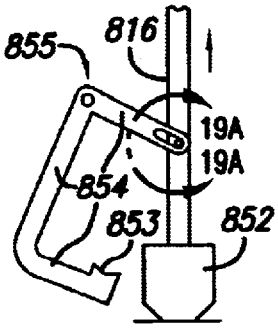
FIGS. 19 through 21 are a sequence of like elevations showing another variant in which the sensor of FIGS. 16 through 18 is automatically capped when not lowered for making measurements.
Figure 26:
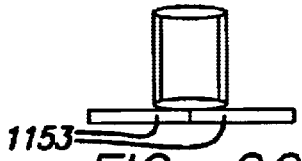
FIGS. 26 and 27 are like FIGS. 24 and 25 except that the doors take the form of shutters that slide laterally out of the shield path.
Figure 27:
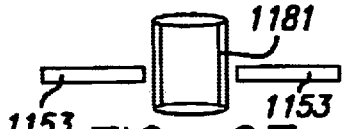
Figure 28:
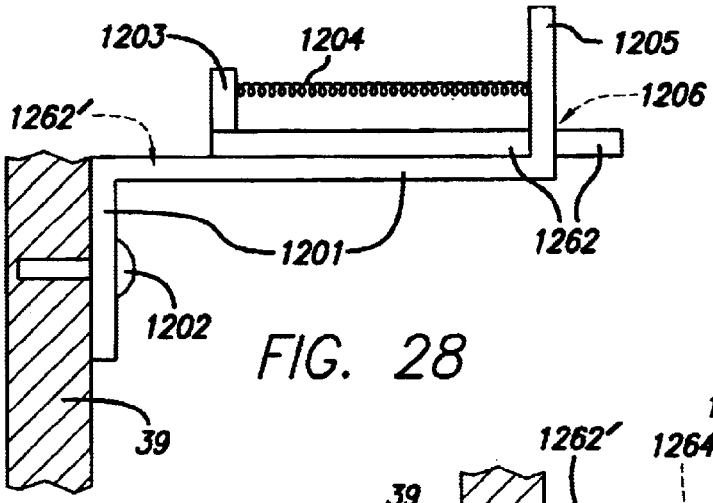
FIG. 28 is an elevation, partially in section and very schematic, of portions of still another preferred embodiment incorporating a stationary reference color target fixed at the right end of the FIG. 3 main carriage assembly—together with a protective carriage-operated sliding shutter (shown partway through its stroke, i. e. partly open) for covering the reference target.

As before, a mechanical solution is also available for the problem of ink aerosol—a cap 853 (FIGS. 19 through 21), door 953, 1053 (FIGS. 22 through 25) or shutter 1153 (FIGS. 26 and 27) that hinges or slides open either when commanded or through operation of a linkage 854 (FIGS. 19 through 21) each time the sensor is lowered against the media. When used in making a measurement the optical elements inside the sensor 852 are exposed (FIG. 19) through its bottom orifice, which contacts the printing medium 4A.

Figure 20:
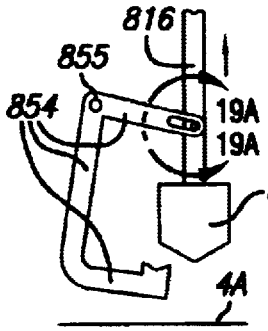

As an example with regard to the linkage 854, when measurement is complete the support shaft 816 is raised (as by a rack-and-pinion 715, 716, FIG. 17), lifting the sensor 852 from the medium 4A (FIG. 20). Fixed to and rising with the support shaft 816 is a slide-pin 856 (FIG. 19A), which in turn raises the slot 857 formed in the upper right corner of the link 854.

Figure 21:
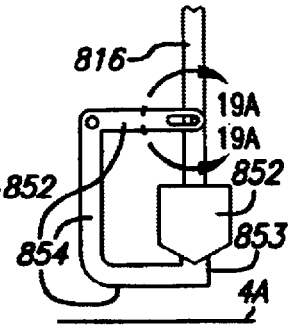
Figure 22:
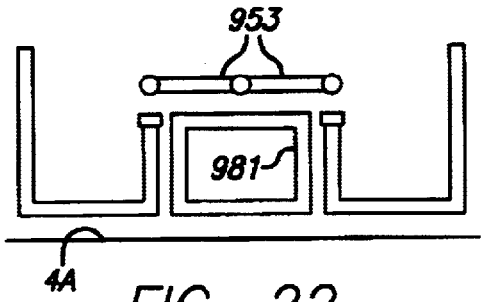
FIGS. 22 and 23 are another sequence of like elevations but showing another preferred embodiment in which a hood or optical shield is lowered from the sensor case toward or onto the printing medium while a pair of trapdoors above the shield is raised.
Figure 23:
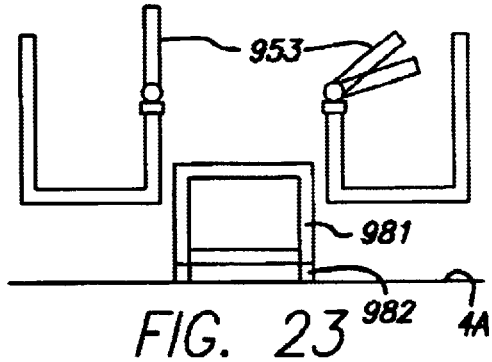
Figure 24:
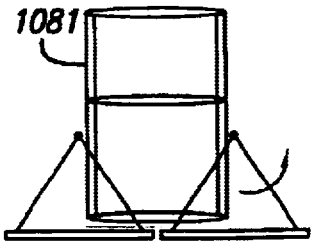
FIGS. 24 and 25 are like FIGS. 22 and 23 except that the doors are initially below the shield, and swung out of the optical path as the shield descends.
Figure 25:
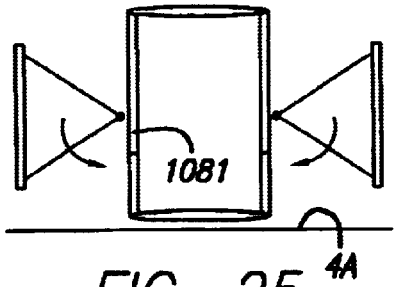

Upward motion of the slot cooperates with the fixed pivot 855 (FIGS. 19 through 21) to force the link 854 into counterclockwise rotation (FIG. 20). This rotation carries the cap 853 around under the sensor orifice and then upward relative to the sensor 852 until the orifice is covered (FIG. 21).

By virtue of the trigonometric properties of the slot-and-pin fitting 856–857 relative to the fixed pivot 855, the cap 853 at first rises more slowly than the sensor 852, until the sensor is well clear of the printing medium and also clear of the cap 853. Then the cap rises more quickly, to catch up with and close the orifice.

Various mechanisms that accomplish these tasks with varying degrees of effectiveness include clamshell doors (not shown) that open to form a partial hood. Also included are trapdoors 1053 that are opened by lowering of a tube-shaped hood 1081 against the print medium.

A soft material can be used as the nose 982 of the sensor hood or tube 981 (FIG. 23) to allow it to conform to the print medium thoroughly; and trapdoors 953 may be above rather than below the tube 981. Also included are rotary shutters as in FIG. 16, which as before may include reference targets. If the system is sensitive to focal distances, separate provision must be made for stopping the sensor assembly at the correct height.

As noted in relation to the illustrations considered earlier, no printing takes place while the swatches are being read. Some ink aerosol may remain in the ambient after printing of the test patterns, and this aerosol may coat the optical elements during the brief period of the swatch-reading mode—but this effect is minuscule compared with the amount deposited during a year of printing as in the cover-glass system of the prior art.

The door or shutter is operated by a separate actuator, or by motion of the carriage against a stop that in turn presses against an on/off trigger (a straightforward adaptation of the following discussion of stationary targets), or is incorporated in the up-and-down actuator so that moving the sensor down causes the door to open through a simple linkage.

Another mechanical solution for a reference target is to place a piece of material 1262' (FIGS. 28 through 31), such as magnesium oxide for example, next to the service station of the printer—i. e., next to the carriage-assembly right end bracket 39. Preferably the target is directly under the color sensor 1252 in the service position, and is at the height of the media 4A (FIG. 2) in the print zone.

Note that the sensor/carriage assembly 1252 (FIG. 31) for this purpose is advantageously a variant configured so that at least the sensor extends beyond the bracket 39 and over the target 1262'. This configuration can be provided by stepping and extending either the pen carriage 20, as shown, or preferably the auxiliary sensor carriage—in an embodiment that includes such an auxiliary carriage.

The sensor can then take an absolute reading for this white reference. In this event there is no focal-distance or illumination-distance error.

When not in use, the target 1262' is covered by a shutter 1262. In this way the reference too is protected from ink aerosol.

Figure 29:
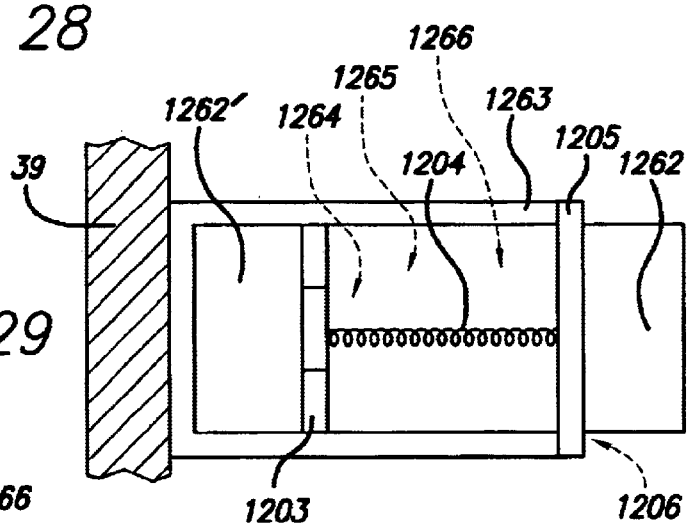
FIG. 29 is a plan of the FIG. 28 target in its shutter assembly.
Figure 30:
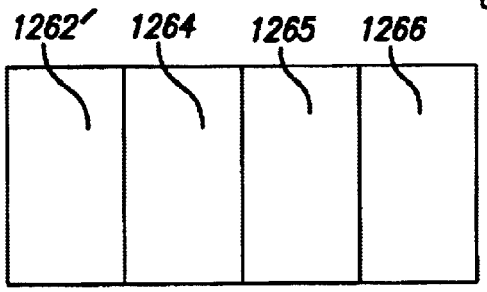
FIG. 30 is a like view of the target alone.
Figure 31:
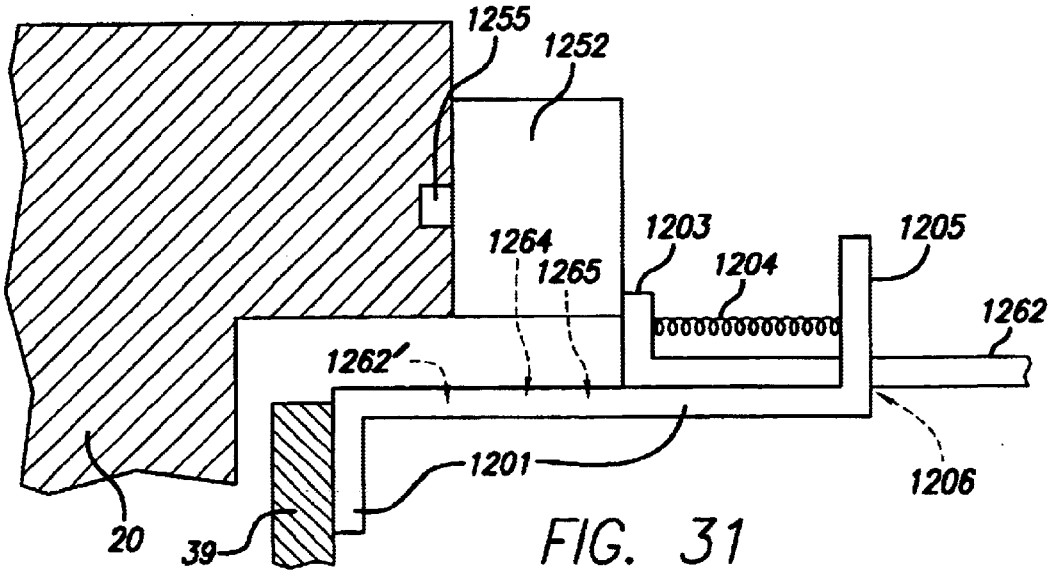
FIG. 31 is a view like FIG. 28, but also showing the main carriage and the sensor/carriage module, actuating the protective shutter (through a greater part of its stroke than in FIG. 28).

In FIG. 29 the target surface 1262' is visible, just to the left of the shutter 1262, 1203. The shutter preferably has a drive plate 1203 that is pushed back by the sensor 1252, as the sensor enters the service station so that no separate electrical actuator is needed.

Preferably this mechanical configuration is used to provide not just one target 1262' but others including for example a black target 1264, at least one neutral gray target 1265 and one or more other targets 1266 if desired. It has been explained earlier that it is extremely advantageous to provide plural gray targets for testing a neutral-gray ramp as constructed from chromatic inks—and chromatic targets too for calibration of, e. g., three saturated primary colors (secondary inks) and three secondary colors (primary inks). A desired total thus comes to ten or more targets.

In FIG. 29 such additional targets 1264–1266 are concealed by the shutter as indicated by presentation of the leadlines in the broken line. (Targets are likewise indicated in FIGS. 28 and 31, as all the targets are concealed within the frame 1201.)

Positioning of both the sensor and the shutter for measurement of one or ten targets—or any intermediate number, or even more—is equally straightforward once the basic illustrated apparatus is provided. The system processor must be suitably coordinated with the particular target array that is physically positioned in the frame.

The shutter is biased 1204 toward its closed position, away from the end plate 1205 of the target frame. Lateral edges of the shutter slide in conventional tracks (not shown) formed in the frame 1201, and a slot 1206 in the end plate 1205 allows the shutter to slide out to uncover the target as illustrated. The target-and-shutter assembly 1201, 1203–1206 is either formed with or fastened 1202 to the main carriage-assembly bracket 39.

Another mechanical solution for one or more reference targets is to place it or them on the inside of a shutter or door as in FIGS. 15 and 16 so that each such target can be exposed to the calorimeter detector when the door is closed. Being on the inside surface of the shutter, each such target is shielded from aerosol when the shutter is closed.

The foregoing discussion of FIGS. 28 through 31 shows that a stationarily mounted door or shutter is very easily arranged for actuation by a moving carriage 1252. In the configuration illustrated and discussed, the shutter and target are fixed to the printer case or to a stationary feature of the carriage assembly (e. g. bracket 39, FIG. 3), and it is a shutter-actuating component of the carriage (e. g., the sensor/carriage 1252 itself) that moves.

It will be entirely clear to those skilled in the art how to straightforwardly adapt such mechanisms for the converse case—i. e., a moving shutter and target actuated by a stationary component of the printer case or of the bracket 39. Such a mechanical arrangement is readily integrated into the configurations shown in any of FIGS. 5 through 16, or FIGS. 22 through 27. In addition it will be understood that the mechanisms of FIGS. 17 through 21 are similarly actuated by action of the carriage 721 against a stationary stop.

The invention is not restricted to thermal-inkjet technology, or to any specific number of colors of ink. Major features are applicable to any printer that creates color effects by depositing dots on printing media; and the invention can be extended to any number of inks of arbitrary colors. As will be recognized by those skilled in the art, particularly with further guidance by the previously mentioned Borrell and Bockman documents, the desired number and character of reference targets may vary accordingly.

In the body of each apparatus claim the word "such" is used as a definite article in lieu of "the" or "said" when referring back to features that are introduced in preamble and are not parts of the invention. This convention is used exclusively, and consistently, with elements of the context or environment of the invention—as distinguished from elements of the claimed invention itself. The purpose is to make the claim more specific and definite, to more distinctly claim and particularly point out what is the claimed invention and what is its context.

The above disclosure is intended as merely exemplary, and not to limit the scope of the invention which is to be determined by reference to the appended claims.

What is claimed is:

1. An incremental printer for forming desired images on a printing medium, by construction from individual marks in arrays; said printer comprising:

at least one colorant-placing module for marking on such medium;

a colorant carriage for holding and moving the at least one colorant-placing module over such medium;

a motor and drive train for propelling said carriage over such medium;

a first sensor, mounted to said carriage, for determining condition or relative positioning of the at least one colorant-placing module;

a second sensor for making color measurements of mark arrays formed on such medium by the at least one module;

an auxiliary carriage for holding and moving the second sensor over such medium; said auxiliary carriage being selectively attachable to and detachable from the colorant carriage, but having substantially no drive train other than that of the colorant-carriage drive train; and means for controlling the motor and drive train, while the carriages are attached, to position the colorant carriage and thereby the auxiliary carriage for substantially stationary measurement of such a mark array on such medium.

2. The printer of claim 1, wherein:

the second sensor is for making calorimetric measurements of the mark arrays.

3. The printer of claim 1, further comprising:

means for excluding ambient light from the second sensor during the making of color measurements.

4. The printer of claim 1, further comprising:

means for presenting at least one color reference target to the second sensor.

5. An incremental printer for forming desired images on a printing medium, by construction from individual marks in arrays; said printer comprising:

at least one colorant-placing module for marking on such medium;

a first sensor for determining condition or relative positioning of the at least one colorant-placing module;

a second sensor for making color measurements of marking arrays formed on such medium by the at least one module; and means for excluding ambient light from the second sensor during the making of color measurements, wherein the ambient-light excluding means comprise:

a hood generally surrounding the second sensor laterally with respect to a sensing direction; and a mechanism for advancing the hood along the sensing direction toward such medium.

6. An incremental printer for forming desired images on a printing medium, by construction from individual marks in arrays; said printer comprising:

at least one colorant-placing module for marking on such medium;

a first sensor for determining condition or relative positioning of the at least one colorant-placing module;

a second sensor for making color measurements of mark arrays formed on such medium by the at least one module; and a mechanism for advancing the second sensor into a measurement position at only low velocity and only low positioning accuracy needed for roughly positioning the second sensor over successive calorimetric test-pattern patches in turn;

wherein said low velocity is on the order of a fraction of 13 inches (34 cm) per second; and said low accuracy is on the order of the dimension of an individual patch.

7. The printer of claim 6, wherein:

the low positioning accuracy is a fraction of said dimension.

8. An incremental printer for forming desired images on a printing medium, by construction from individual marks in arrays; said printer comprising:

at least one colorant-placing module for marking on such medium;

a colorant carriage for holding and moving the at least one colorant-placing module over such medium;

a motor and drive train for propelling said carriage over such medium;

a first sensor, mounted to said carriage, for determining condition or relative positioning of the at least one colorant-placing module;

a second sensor for making color measurements of mark arrays formed on such medium by the at least one module;

an auxiliary carriage for holding and moving the second sensor over such medium; said auxiliary carriage being selectively attachable to and detachable from the colorant carriage, but having substantially no drive train other than that of the colorant-carriage drive train;

means for controlling the motor and drive train, while the carriages are attached, to position the colorant carriage and thereby the auxiliary carriage for substantially stationary measurement of such a mark array on such medium; and a mechanism for advancing a component associated with the second sensor into contact with such medium.

9. An incremental printer for forming desired images on a printing medium, by construction from individual marks in arrays; said printer comprising:

at least one colorant-placing module for marking on such medium;

a first carriage for holding and moving the at least one colorant-placing module over such medium; and a motor and drive train for propelling said first carriage over such medium;

a second carriage, discrete from the first carriage, for use in refining the quality of images produced by the printer; said auxiliary carriage being selectively attachable to and detachable from the first carriage, but having substantially no drive train other than that of the first-carriage drive train; and means for controlling the motor and drive train, while the carriages are attached, to position the first carriage and thereby the second carriage for substantially stationary operation in refining the quality of images.

10. An incremental printer for forming desired images on a printing medium, by construction from individual marks in arrays; said printer comprising:

at least one colorant-placing module for marking on such medium;

a first carriage for holding and moving the at least one colorant-placing module over such medium at a speed for marking; and a second carriage, discrete from the first carriage, for use in refining the quality of images produced by the printer;

wherein the second carriage scans a sensor over such medium at only low velocity and only low positioning accuracy needed for roughly positioning the second sensor over successive calorimetric test-pattern patches in turn;

said low velocity is a fraction of said marking speed; and said low accuracy is on the order of the dimension of an individual patch.

11. The printer of claim 10, wherein:

said low velocity is a fraction of 13 inches (34 cm) per second; and the low positioning accuracy is a fraction of said dimension.

12. An incremental printer for forming desired images on a printing medium, by construction from individual marks in arrays; said printer comprising:

at least one colorant-placing module for marking on such medium;

a first carriage for holding and moving the colorant-placing module over such medium; and a second carriage, discrete from the first carriage, for use in refining the quality of images produced by the printer;

wherein the second carriage scans a sensor over such medium at only low velocity and only low positioning accuracy needed for roughly centering the second sensor over successive calorimetric test-pattern patches in turn; wherein:

the sensor is a sensor for making color measurements of marks formed on such medium by the at least one colorant-placing module; and the second carriage also holds at least one reference target for presentation to the sensor.

13. The printer of claim 12, wherein:

the sensor is a calorimetric sensor; and the reference target is a calorimetric reference target.

14. An incremental printer for forming desired images on a printing medium, by construction from individual marks in arrays; said printer comprising:

at least one colorant-placing module for marking on such medium;

a first carriage for holding and moving the colorant-placing module over such medium; and a second carriage, discrete from the first carriage, for use in refining the quality of images produced by the printer;

wherein the second carriage scans a sensor over such medium at only low velocity and only low positioning accuracy needed for roughly centering the second sensor over successive calorimetric test-pattern patches in turn; further comprising:

a hood generally surrounding the sensor laterally with respect to a sensing direction; and a mechanism for advancing the hood along the sensing direction toward such medium.

15. An incremental printer for forming desired images on a printing medium, by construction from individual marks in arrays; said printer comprising:

at least one colorant-placing module for marking on such medium;

a first carriage for holding and moving the colorant-placing module over such medium; and a second carriage, discrete from the first carriage, for use in refining the quality of images produced by the printer;

wherein the second carriage scans a sensor over such medium at only low velocity and only low positioning accuracy needed for roughly centering the second sensor over successive calorimetric test-pattern patches in turn; further comprising:

a mechanism for advancing a component associated with the sensor into contact with such medium.

16. An incremental printer for forming desired images on a printing medium, by construction from individual marks in arrays; said printer comprising:

at least one colorant-placing module for marking on such medium;

a sensor for measuring color properties of colorant marked on such medium by the colorant-placing module;

a hood generally surrounding the sensor laterally with respect to a sensing direction, for excluding ambient light from the sensor during the color-property measuring; and a mechanism for automatically advancing the hood along the sensing direction toward such medium.

17. The printer of claim 16, wherein:

the hood-advancing mechanism advances the hood into contact with such medium.

18. The printer of claim 17, wherein:

the hood comprises, at a forward surface thereof, a compliant material for facilitating an effective contact between the hood and such medium.

19. The printer of claim 16, wherein:

the hood is movable with respect to the sensor; and the hood-advancing mechanism is for advancing the hood with respect to the sensor.

20. The printer of claim 19, wherein:

the hood-advancing mechanism advances the hood into contact with such medium.

21. The printer of claim 20, wherein:

the hood comprises, at a forward surface thereof, a compliant material for facilitating an effective contact between the hood and such medium.

22. The printer of claim 16, further comprising:

a door for protecting the sensor when not in use;

wherein the hood-advancing mechanism also comprises means for opening the door for measurements by the sensor.

23. An incremental printing system for forming desired images on a printing medium, by construction from very large numbers of individual liquid-ink drops ejected onto such medium in arrays; said printing system comprising:

at least one inkdrop-placing module for ejecting very large numbers of liquid-ink drops onto such medium substantially whenever the printing system is in use for forming images;

at least one sensor, having at least one optical surface, for infrequently measuring, substantially when the printing system is not in use for forming images, characteristics of ink previously received on such medium from the at least one inkdrop-placing module;

an automatic microprocessor for using the measured characteristics in refining operation of the inkdrop-placing module, to optimize the quality of images formed on such medium thereafter;

a door for protecting the at least one optical surface of the at least one sensor from being coated by atmospherically carried residual liquid ink when the at least one sensor is not in use, including whenever the printing system is in use for forming images; and a mechanism for automatically opening the door before use of the at least one sensor, and for automatically closing the door after use of the at least one sensor;

wherein the microprocessor can reliably optimize the quality of images, free from measurement degradation by coating of liquid ink on the at least one optical surface; and means for measuring at least one absolute color reference when the door is not open to admit color characteristics of the previously received ink to the sensor.

24. The printing system of claim 23, wherein:

the door-opening mechanism also moves the sensor into a measurement position.

25. The printing system of claim 23, wherein the door-opening-and-closing mechanism is:

for automatically opening the door substantially in preparation for use of the sensor; and also for automatically closing the door promptly after use of the sensor.

26. The printing system of claim 23, wherein:

the at least one sensor has multiple optical surfaces; and the door is for protecting substantially all of the multiple optical surfaces from being coated by atmospherically carried residual liquid ink when the at least one sensor is not in use, including whenever the printing system is in use for forming images.

27. The printing system of claim 23, wherein the at least one sensor comprises:

a sensor for measuring color properties of the previously received ink; and a sensor for determining, from patterns of the previously received ink, condition of the at least one inkdrop-placing module.

28. The printing system of claim 23, wherein:

the at least one inkdrop-placing module comprises at least two modules for placing ink; and the at least one sensor comprises:

a sensor for measuring color properties of the previously received ink, and a sensor for use in determining, from patterns of the previously received ink, condition or relative positioning, or both, of the inkdrop-placing modules.

29. The printing system of claim 23, wherein:

the absolute-reference measuring means comprise at least one color reference target that is exposed to the sensor when the door is closed.

30. The printing system of claim 29, wherein:

the color reference target is carried on a surface of the door.

31. The printing system of claim 23, wherein:

the door is a shutter.

32. The printing system of claim 31, wherein:

the shutter is in a plane generally parallel to such printing medium, and slides open and shut generally within said plane.

33. An incremental printer for forming desired images on a printing medium, by construction from individual marks in arrays; said printer comprising:

at least one colorant-placing module for marking on such medium;

a sensor for measuring color properties of colorant marked on such medium by the colorant-placing module;

a moving carriage for automatically positioning the sensor over colorant on such medium; and at least one reference target disposed for exposure to the sensor to provide a colorimetric reference measurement for use in conjunction with said measured color properties of colorant marked on such medium;

wherein the at least one reference target is carried on the moving carriage.

34. The printer of claim 33, wherein:

the at least one reference target is stationary, and the moving carriage comprises means for automatically positioning the sensor over the at least one reference target.

35. The printer of claim 34, further comprising:

a shutter for protecting the at least one reference target; and means actuated by the moving carriage for controlling the shutter.

36. The printer of claim 33, wherein:

the at least one reference target comprises a white target.

37. The printer of claim 36, wherein:

the at least one reference target also comprises a black target.

38. The printer of claim 33, wherein:

the at least one reference target comprises one or more gray targets.

39. The printer of claim 38, wherein:

the at least one reference target also comprises a chromatically colored target.

40. An incremental printer for forming desired images on a printing medium, by construction from individual marks in arrays; said printer comprising:

at least one colorant-placing module for marking on such medium;

a colorant carriage for holding and moving the at least one module over such medium;

a motor and drive train for propelling said carriage over such medium;

a first sensor, mounted to said carriage, for determining condition or relative positioning of the at least one colorant-placing module;

a second sensor for making color measurements of mark arrays formed on such medium by the at least one module;

an auxiliary carriage for holding and moving the second sensor over such medium; said auxiliary carriage being selectively attachable to and detachable from the colorant carriage, but having substantially no drive train other than that of the colorant-carriage drive train; and a mechanism for advancing a component associated with the second sensor into contact with such medium.

* * * * *